US008176644B1

(12) United States Patent
Summers et al.

(10) Patent No.: US 8,176,644 B1
(45) Date of Patent: May 15, 2012

(54) PRODUCING AND USING ARCHERY SIGHTS

(75) Inventors: Gregory E. Summers, Amherst, VA (US); Daniel Edward Ellgass, Big Island, VA (US)

(73) Assignee: Gregory E. Summers, Madison Heights, VA (US)

( * ) Notice: Subject to any disclaimer, the term of this patent is extended or adjusted under 35 U.S.C. 154(b) by 380 days.

(21) Appl. No.: 12/332,410

(22) Filed: Dec. 11, 2008

Related U.S. Application Data

(60) Provisional application No. 61/105,938, filed on Oct. 16, 2008.

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | | |
|---|---|---|---|---|---|
| 4,011,853 | A | * | 3/1977 | Fletcher | 124/87 |
| 4,020,560 | A | | 5/1977 | Heck | |
| 4,328,625 | A | * | 5/1982 | Carella | 33/265 |
| 4,495,705 | A | | 1/1985 | Kowalski et al. | |
| 4,584,777 | A | | 4/1986 | Saunders | |
| 4,656,747 | A | * | 4/1987 | Troncoso | 33/265 |
| 5,092,053 | A | | 3/1992 | Roberts | |
| 5,325,598 | A | * | 7/1994 | Hall et al. | 33/265 |
| 5,384,966 | A | | 1/1995 | Gibbs | |
| 5,388,336 | A | | 2/1995 | Pomaville | |
| 5,697,357 | A | * | 12/1997 | Chipman | 124/87 |
| 5,860,408 | A | * | 1/1999 | Summers | 124/87 |
| RE36,266 | E | | 8/1999 | Gibbs | |
| 5,996,569 | A | * | 12/1999 | Wilson | 124/87 |
| 6,000,141 | A | | 12/1999 | Afshari | |
| 6,282,800 | B1 | * | 9/2001 | Beutler | 33/265 |
| 6,446,347 | B1 | | 9/2002 | Springer | |
| 6,508,005 | B2 | | 1/2003 | Springer | |
| 6,560,884 | B1 | | 5/2003 | Afshari | |
| 6,601,308 | B2 | | 8/2003 | Khoshnood | |
| 6,725,854 | B1 | | 4/2004 | Afshari | |
| 6,938,349 | B2 | | 9/2005 | Afshari | |
| 6,981,329 | B1 | * | 1/2006 | Strathman | 33/265 |
| D522,083 | S | | 5/2006 | Afshari | |

(Continued)

OTHER PUBLICATIONS

"Shibuya Products—Sight," pritnted from www.shibuya-archery.com on Oct. 30, 2006, 11 pages.

(Continued)

*Primary Examiner* — Yaritza Guadalupe-McCall
(74) *Attorney, Agent, or Firm* — Leading Edge Law Group, PLC

(57) ABSTRACT

An archery sight can include a scope with a Venturi-like inner opening, smaller in diameter at a narrow position and increasing in diameter toward each end, to provide a circular field of view through a range of off-axis angles. Archery sights with pins, such as extending into a scope, can include sight pin components that include bodies, tube-like parts extending to sight pin ends, optical fibers in the bodies and tube-like parts, and flexible, light-transmissive tubing that engages the bodies and surrounds the fibers along most of their exterior length. Each tube-like part can be attached to its body by inserting it into a portion of the body that surrounds it and then bending the portion of the body to produce one or more bends or kinks but without reducing inside diameter, so that a fiber can then be threaded through the tube-like part.

18 Claims, 21 Drawing Sheets

U.S. PATENT DOCUMENTS

| | | | | |
|---|---|---|---|---|
| 7,082,690 | B1 | 8/2006 | Khoshnood | |
| 7,100,291 | B2 | 9/2006 | Afshari | |
| 7,100,292 | B2 | 9/2006 | Afshari | |
| 7,103,981 | B1 | 9/2006 | Rager | |
| 7,159,325 | B2 | 1/2007 | Rager | |
| 7,200,943 | B2 | 4/2007 | Afshari | |
| RE39,686 | E | 6/2007 | Khoshnood | |
| 7,266,896 | B1 * | 9/2007 | White | 33/265 |
| 7,275,329 | B2 | 10/2007 | Rager | |
| 7,503,122 | B2 * | 3/2009 | Afshari | 33/265 |
| 7,543,389 | B2 * | 6/2009 | Grace, Jr. | 33/265 |
| 7,543,390 | B2 * | 6/2009 | Bach | 33/265 |
| 2007/0157480 | A1 | 7/2007 | Rager | |

OTHER PUBLICATIONS

Stanislawski Archery Products brochure, 1974 Desert Inn Classic, 8 pages.

* cited by examiner

PRODUCING AND USING ARCHERY SIGHTS

This application claims the benefit of U.S. Provisional Patent Application No. 61/105,938, filed Oct. 16, 2008, entitled "Producing and Using Archery Sights".

FIELD OF THE INVENTION

The present invention relates generally to sights used by archers, and more specifically to techniques that produce and/or use archery sights.

BACKGROUND OF THE INVENTION

Many techniques have been proposed for archery sights.

It would be advantageous to have improved techniques relating to archery sights.

SUMMARY OF THE INVENTION

The invention provides various exemplary embodiments, including articles, systems, apparatus, devices, products and methods. In general, the embodiments are implemented in relation to production and use of archery sights and/or features of archery sights.

These and other features and advantages of exemplary embodiments of the invention are described below with reference to the accompanying drawings.

DETAILED DESCRIPTION

Figure 1:
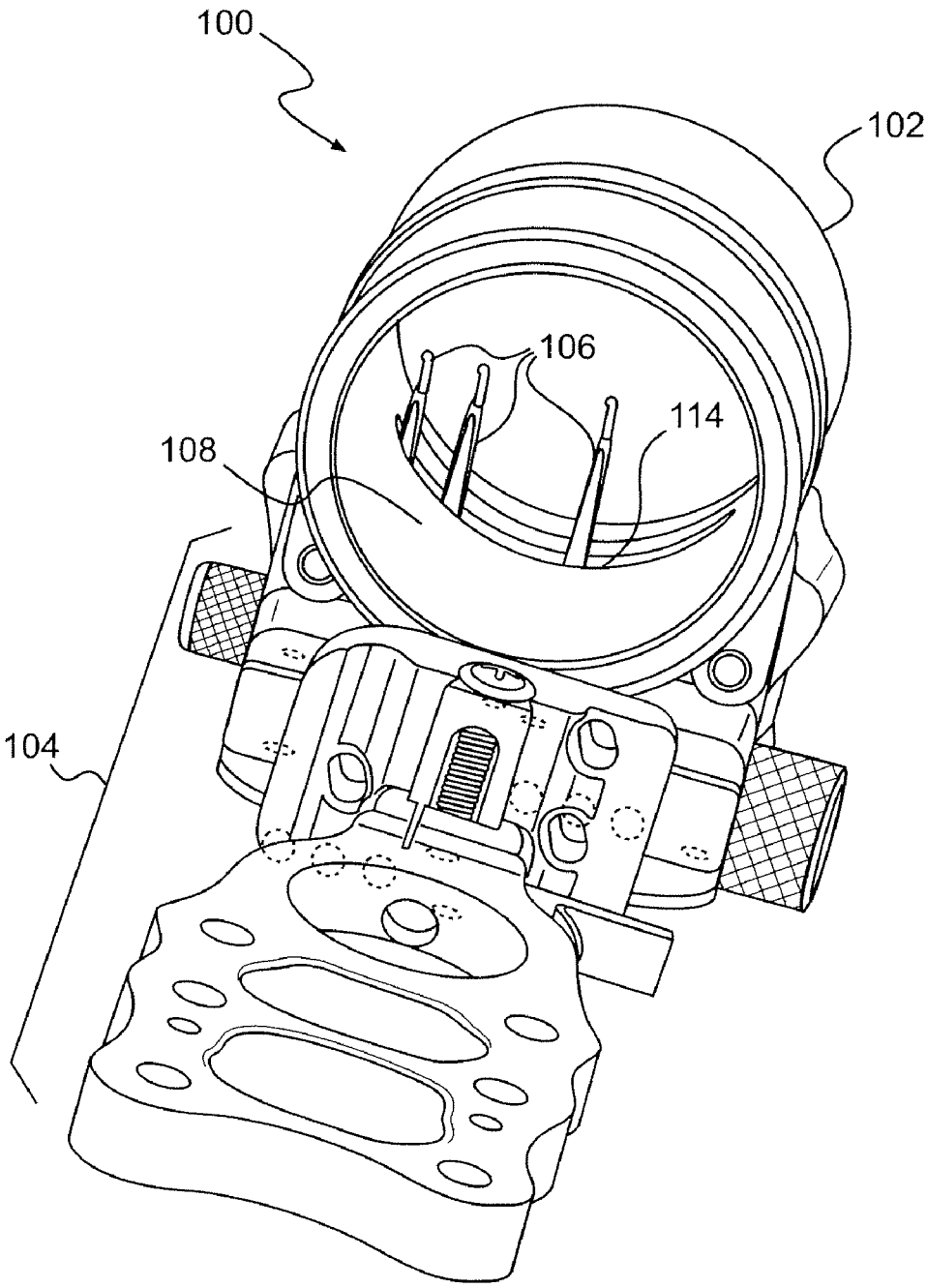
FIG. 1 is a perspective view of an archery sight that includes a sight frame component and a support component.

In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary, and are not intended to limit the scope of the claims.

The term "archery sight" (or simply "bowsight" or "sight") is used herein to mean any of various structures, devices, and other products used by an archer holding a bow and arrow to visually aim the arrow toward a target before releasing the arrow from the bow. Many archery sights include a "scope", meaning a component through which an archer can view a target; a scope could, for example, be a telescope-like magnifying component, but a scope need not perform magnification, as illustrated by some of the exemplary implementations herein. Also, many archery sights, sometimes referred to as "pin sights", include sight pins, where the term "sight pin" means a structure that extends to an end, i.e., a "sight pin end", in an archer's field of view, or simply "field"; in use, an archer may move the bow to position the sight pin end such that an arrow hits the target.

Scopes, pin sights, and other such components through or past which an archer can view and aim at a target are sometimes referred to herein as "viewing parts". Viewing parts are typically supported on bows, and the term "archery sight" is used herein to refer not only to viewing parts by themselves but also to structures that can be used to support a scope or other viewing part on a bow and, where appropriate, to combinations of viewing parts with such supporting structures.

The implementations described below address problems that arise with archery sights. One problem is that a field viewed through a typical scope changes shape as the user moves from the scope's central axis. Another problem, relating to sights with a number of sight pins, is that individual sight pin position is often difficult to adjust, and there can be a tension between easy adjustment and stable positioning of a sight pin in a desired position. Further problems, relating to sight pins that contain optical fibers for illumination, relate to fragility of optical fibers, which can be damaged during production of a sight pin or during use, such as by contact, touching, vibration, and so forth. These and related problems often operate together, and exemplary implementations described herein address combinations of these and other problems in various ways.

In general, the implementations described below involve combinations of parts or components. As used herein, a "system" is a combination of two or more parts or components that together can operate as a whole. Some parts or components are described herein in relation to their operations, while other parts or components are described in relation to structural features such as shape.

In the implementations described below, apparatus, systems, or parts or components of apparatus or systems are referred to as "attached" to each other or to other apparatus, systems, parts, or components or vice versa, and operations are performed that "attach" apparatus, systems, or parts or components of apparatus or systems to each other or to other things or vice versa; the terms "attached", "attach", and related terms refer to any type of connecting that could be performed in the context. One type of attaching is "mounting", which occurs when a first part or component is attached to a second part or component that functions as a support for the first. In contrast, the more generic term "connecting" includes not only "attaching" and "mounting", but also making other types of connections such as between or among parts formed as a single piece of material by molding or other fabrication, in which case connected parts are sometimes referred to as "integrally formed".

A combination of one or more parts connected in any way is sometimes referred to herein as a "structure". Similarly to a component, a structure may be described by its operation, such as a "support structure" that can operate as a support. Some structures are also described by structural features.

FIG. 1 shows an implementation of an archery sight 100 that includes a scope 102 that serves as a sight frame component attached to a support component 104. Support component 104 includes a light receiving region. The scope 102 surrounds sight pins 106. In the illustrated example, sight pins 106 extend through a slot 114 defined in scope 102. The implementation shown in FIG. 1 shows three sight pins 106, but more or fewer sight pins 106 may be used within scope 102, as desired.

Figure 2:
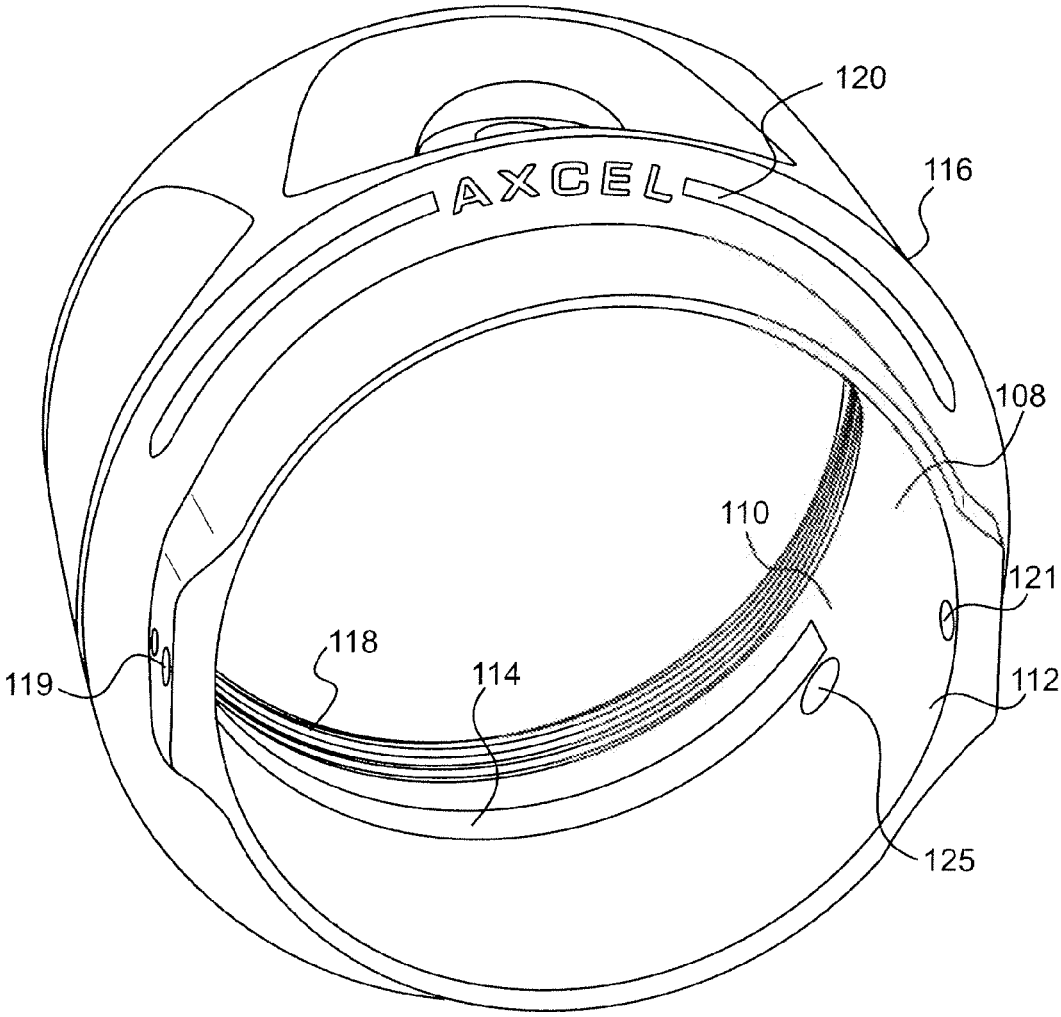
FIG. 2 is a perspective view of a scope as in FIG. 1.

FIG. 2 shows an implementation of a scope 102 that can be used in archery sight 100. Scope 102 is a slightly different implementation from that shown in FIG. 1 and can be mounted on a body part of archery sight 100 by a rivet, a screw, or similar devices.

Referring to FIGS. 1-2, scope 102 includes an inner surface 108 that defines a sight opening within which a user of a bow on which sight 100 is mounted can see sight pins 106 for alignment with a target. Inner surface 108 of scope 102 is shaped so that the user sees a substantially circular frame around sight pins 106 when viewing the opening along a central axis and in any direction within about seven degrees from the central axis. Inner surface 108 of scope 102 defines boundary segments that the user views as substantially circular when viewing the opening along a central axis and in any direction within about seven degrees of the central axis.

When using the archery sight 100, the user lines up the appropriate sight pin 106 with the intended target to aid in aiming an archery shot. Each sight pin 106 corresponds to an approximate distance to the target. For example, one sight pin 106 might correspond to a distance of about 20 yards, a second sight pin 106 might correspond to a distance of about 40 yards, and a third sight pin might correspond to a distance of about 60 yards.

In a particular implementation, inner surface 108 of scope 102 will typically include an inner diameter that is narrower at a position near the center 110 than it is toward each edge 112 of the sight opening. The position with the narrowest diameter is sometimes referred to as the "waist point" of scope 102. This varying diameter provides a Venturi-like effect where the sight opening appears substantially circular when viewed from various directions, even if the user is not viewing scope 102 straight on. Thus, even if the user is not viewing sight pin 106 and target straight on through scope 102, the varying diameter still provides a clear circular view to aid in the shot.

Figure 3:
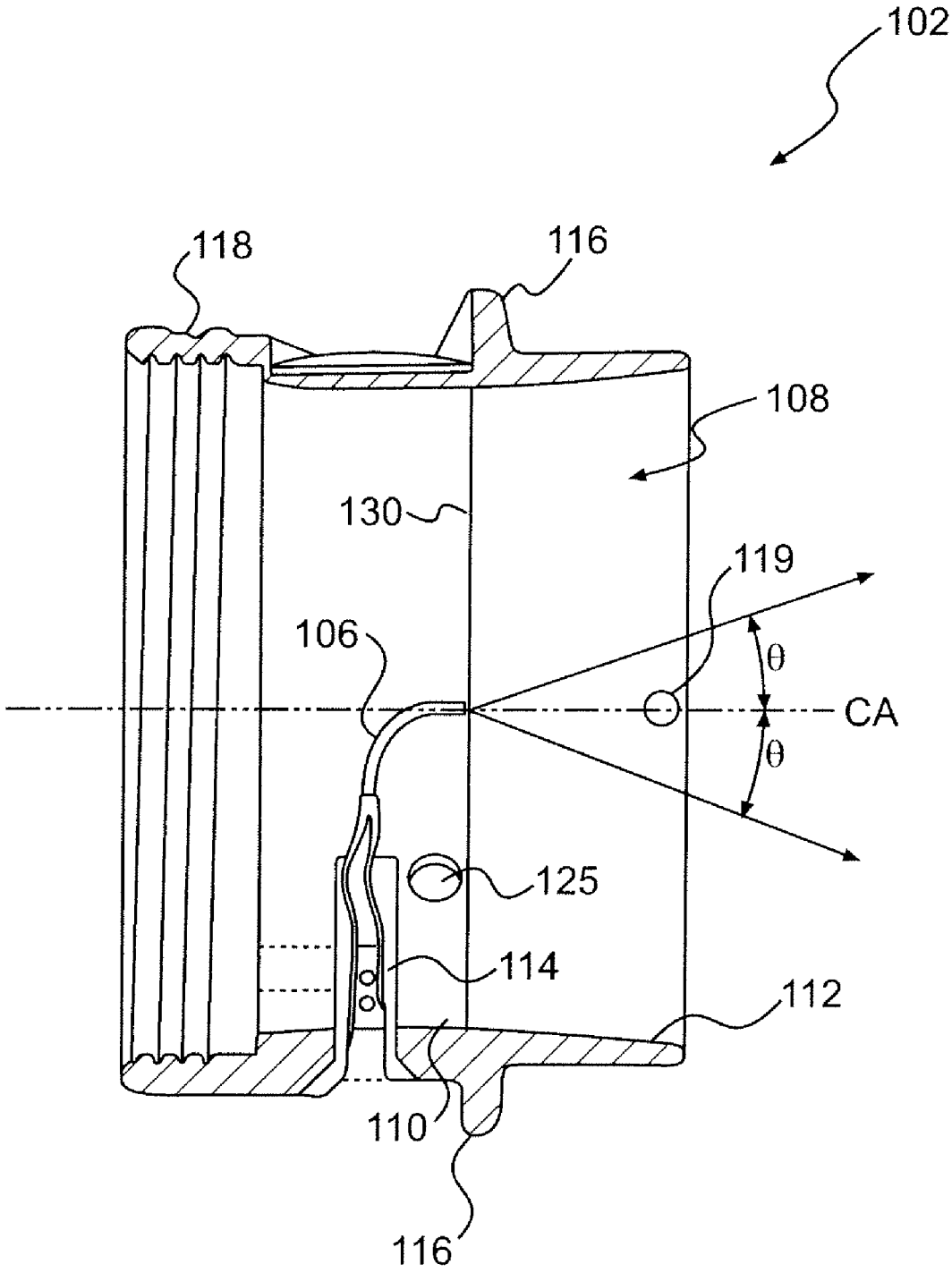
FIG. 3 is a cross-sectional view of a scope as in FIGS. 1-2.

FIG. 3 shows a cross-section of scope 102, as shown in FIG. 2, that has been formed by machining or the like. The inner diameter near the center 110 is slightly smaller than inner diameter near either edge 112. For example, in one implementation, the inner diameter at center 110 is 1.625 inches and inner diameter near edge 112 is 1.711 inches. In this implementation, the radius of curvature of scope 102 is about 5.5 inches to provide a Venturi-like effect. Slot or opening 114 permits sight pin 106 to be housed within scope 102 when the archery sight is fully assembled. A single sight pin is shown in FIG. 3; additional sight pins would generally be used in most implementations.

Shoulder 116 that includes engraving 120 (shown in FIG. 2) encircles scope 102 to provide a target aiming aid for the user. Engraving 120 is an example of an alignment aid and may be implemented as a sticker, paint or other indicia applied to shoulder 116 that can aid the user in aiming the sight. The tips of the sight pins (where the end of the fiber is visible) and shoulder 116 with engraving 120 are approximately in line with the smallest point of the inner diameter near center 110 along line 130. The smallest diameter should be near the center of inner surface 108 of scope 102, but does not have to be precisely in the center provided that it creates the desired Venturi-like effect. By having engraving 120 at the same depth on scope 102 as the tips of the sight pins, i.e., in alignment along line 130 at the same point along the central axis, the circular reference of engraving 120 provides greater accuracy when viewed by a user off angle, i.e., along angles θ or greater. Having an alignment aid such as engraving 120 at a different location along scope 102, such as along the front face, would provide distortion of the centering accuracy when viewed off angle.

Threads 118 permit a lens to be added to the sight, as desired. The lens can provide magnification of the target or other desired effect. Holes 125 are used to attach scope 102 to support component 104 by hex screws or the like. Holes 119 and 121 are used to attach a bubble level to the scope. Hole 119 is used for the bubble level when used by a right-handed archer; the bubble level can be removed and moved to hole 121 when used by a left-handed archer. Bubble level is attached by hex screws or similar attachments.

Scope 102 has a central axis CA that runs approximately through its center. Under ideal conditions, a user would view the target along central axis CA to get a view that is undistorted. The Venturi-like effect permits the user to see an undistorted image (i.e., the viewing frame remains substantially circular) at viewing angles θ with respect to central axis CA. The term "Venturi-like effect" as used herein refers to the effect where the viewing frame remains substantially circular at viewing angles θ based on a narrowing in the center of the scope, as compared to the diameters at either end. In standard scopes without the differing diameter as described, any change in viewing angle θ from central axis CA results in the viewing frame becoming distorted. By implementing the differing diameters, a change in viewing angle θ from CA in the range of one degree up to three degrees, or even up to about seven degrees, does not result in distortion and maintains a round viewing frame to the user. In one implementation, a change in viewing angle θ from CA in a range greater than zero degrees and up to about five degrees does not result in distortion and maintains a round viewing frame to the user. These angular ranges are, of course, merely exemplary, and do not limit the scope of invention, which encompasses any such difference in diameter, whether only sufficient to produce a small angular range that is only slightly greater than zero up to significantly larger angular ranges, perhaps even up to 10 or 20 degrees.

Various other sight frame components could be produced and used similar to scope 102, with similar effects on the field viewed by a user. For example, rather than providing a continuous circular boundary around a frame, a sight frame component might be implemented with a number of inner surface regions with gaps between them, such as regions above, below, left, and right of the view field; the inner surface regions could be similarly shaped as described above so that they provide the same view shape across a range of angles.

Figure 4:
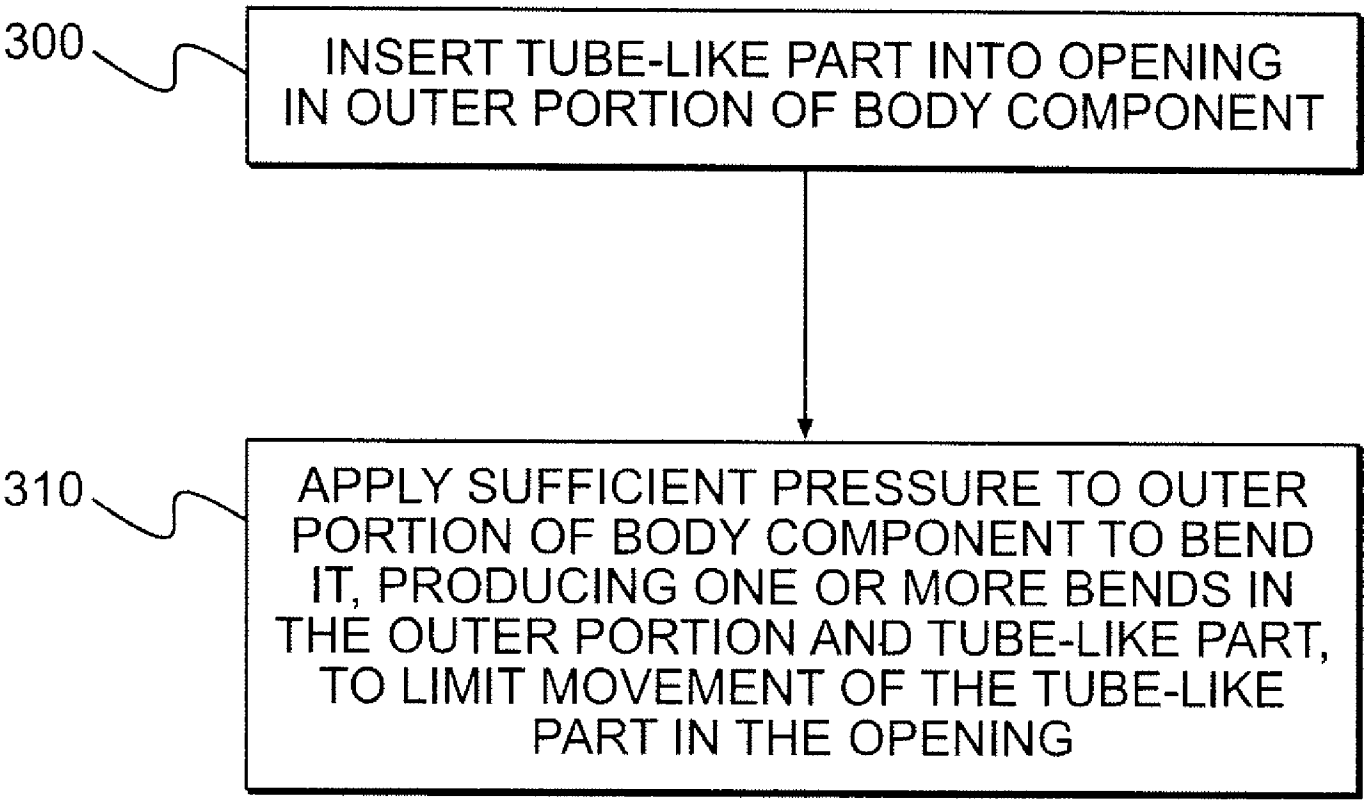
FIG. 4 is a flow diagram showing operations that can be performed to produce a support structure as in FIG. 1.

FIG. 4 shows exemplary operations that can produce a support structure for an optical fiber in an archery sight as disclosed herein. The sight includes a body part, a scope, and at least one sight pin within the scope. The sight pin includes a sight pin body component and a tube-like part. The sight pin body component has an outer portion that includes an opening where optical fiber may pass through. As used herein, the term "tube-like part" refers to a part that is in the shape of a tube or similar structure having a hollow interior and openings at each end to permit another object or component to pass through the interior of the part. A tube-like part may have a circular cross-section or it may have another shape so long as the interior is hollow and it includes openings at each end.

In operations in box 300, a tube-like part is inserted into the outer portion of the sight pin body component. The tube-like part has an outer diameter that is slightly smaller than the inner diameter of the opening in the outer portion of the sight pin body component so that the tube-like part can fit within the opening in the sight pin body component.

In operations in box 310, sufficient pressure is exerted on the outer portion of the sight pin body component (but not directly on the tube-like part) to produce one or more bends or kinks in the sight pin body component's outer portion and the tube-like part inside it. The bends or kinks in the tube-like part and the outer portion of the sight pin body component limit movement of the tube-like part within the opening. The bends or kinks are intended to hold the tube-like part securely and keep it from separating from the sight pin body component without the need for screws, rivets, or other attachment device, and without the need for adhesive, welding, bonding or the like. It is important to maintain the integrity of the inner diameters of the tube-like part and the outer portion of the sight pin body component to keep from crushing an optical fiber that may be contained therein. Also, because pressure is not exerted directly on the tube-like part, but only indirectly from the inner wall of the outer portion, its inner diameter is maintained and is not crimped or damaged; as a result, a set of one or more fibers can be threaded or inserted through it without damaging the fibers which are generally fragile.

The bends or kinks in the outer portion of the sight pin, as well as the curvature at the end of the sight pin where the optical fiber can be seen, may be formed by roll forming, where the piece is passed between a number of rollers to get the desired shape, or by similar methods that would give the desired effect, such as by press forming with a bending die, a crimping die, or other appropriate die. This ensures that the bends or kinks are sufficient to keep the tube-like part securely in place without compromising the inner diameter of the tube-like part, which would result in damaging the optical fiber. Finally, once the bends or kinks are made in the outer portion of the sight pin, the end of the tube-like part of the pin is bent at an angle of about 90° so that when the lighted end of the fiber sticks out of the tube-like part of the pin within the scope, it faces the user.

Figure 5:
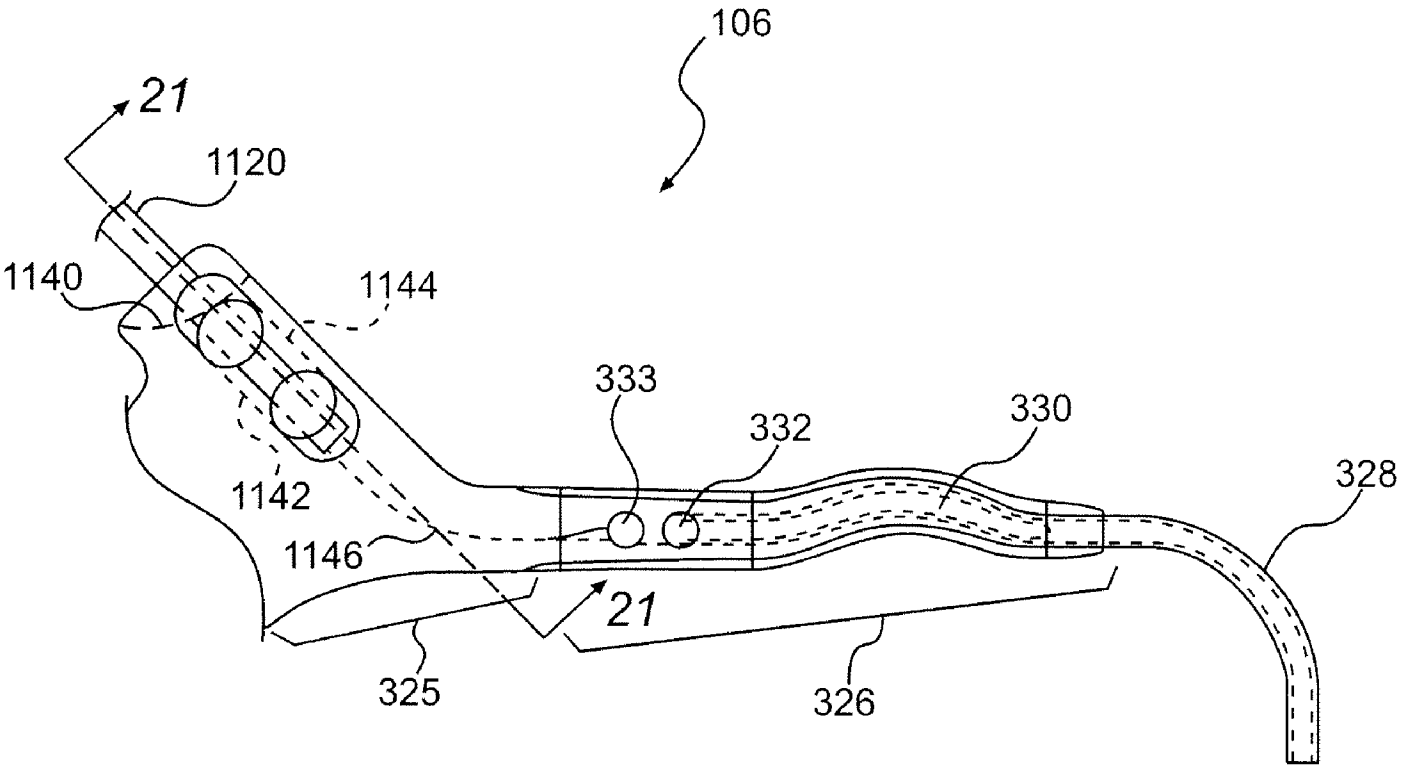
FIG. 5 is a side view in partial cross-section of a sight pin as in FIGS. 1 and 3.
Figure 6:
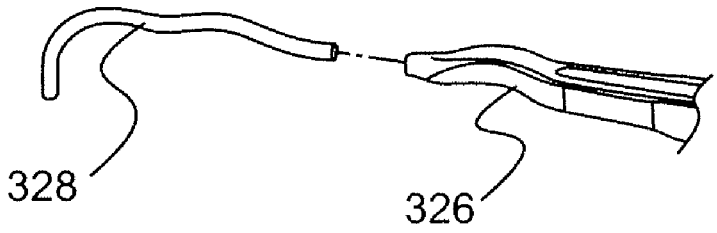
FIG. 6 is an exploded view of an outer portion of a sight pin and a tube-like part as in FIG. 5.

FIG. 5 shows an implementation of sight pin 106 that includes body component 325, outer portion 326, and tube-like part 328. Outer portion 326 includes an internal opening 330 that permits an optical fiber to run from body component 325 to tube-like part 328. At the end of tube-like part 328, the optical fiber provides illumination which permits aiming of the archery shot, such as in low light conditions. Tube-like part 328 is inserted into opening 330 in outer portion 326 until it is stopped by indentation 332 or indentation 333. Tube-like part 328 has a slightly smaller diameter than opening 330 to permit tube-like part 328 to slide inside opening 330, while permitting a relatively tight fit. Indentation 333 has a slightly smaller diameter than indentation 332. In one implementation, indentation 332 has a slightly smaller diameter than tube-like part 328, keeping tube-like part 328 from sliding past indentation 332. This implementation is shown in an exploded view in FIG. 6 as tube-like part 328 would fit directly into outer portion 326. This implementation may be used with, for example, a 0.032 inch outer diameter tube-like part 328.

Tube-like part 328 may be formed of stainless steel or similar material. In one implementation, tube-like part 328 is pre-cut to the desired length. Cutting should be performed carefully to avoid burs or other imperfections that could damage the optical fiber that will be inserted within tube-like part 328. Cutting can be performed in water or with diamond saws or the like to avoid potential problems of this sort.

Figure 7:
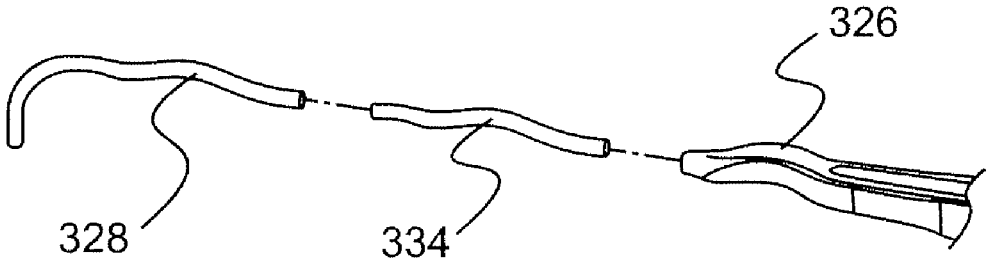
FIG. 7 is an exploded view of an outer portion of a sight pin and a tube-like part with an intermediate tube as in FIG. 5.

In another implementation, a smaller tube-like part 328 may be used, such as when a smaller optical fiber is desired. In this implementation, shown in FIG. 7, an intermediate tube 334 is used. Tube-like part 328 slides into tube 334 which in turn is inserted into outer portion 326. Tube 334 is still stopped by indentation 332, but the smaller diameter of tube-like part 328 permits it to slide further to be stopped by indentation 333. For example, if a 0.022 inch outer diameter tube-like part 328 is desired, it is inserted into a 0.032 outer diameter tube 334 which is in turn inserted into outer portion 326. The smaller OD tube-like part 328 is used for optical fibers having outer diameters of about 0.009 inch, and the larger 0.032 OD tube-like part is used for fibers having an OD of about 0.019 inch. While these sizes have been successfully implemented, it should be understood that other sizes are also possible as desired.

Figure 8:
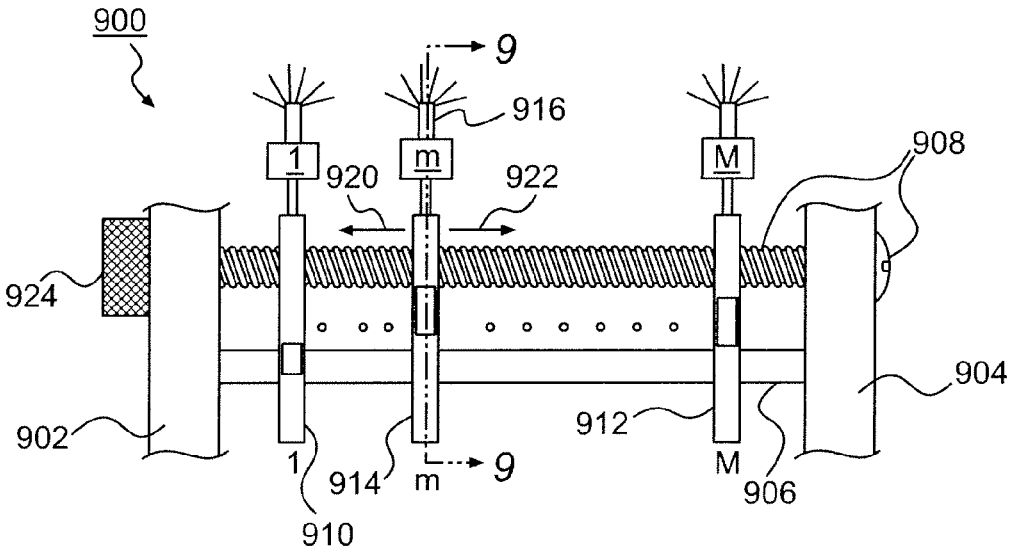
FIG. 8 is a partially schematic view of a sight pin support system with features that could be used in an archery sight as in FIG. 1.
Figure 9:
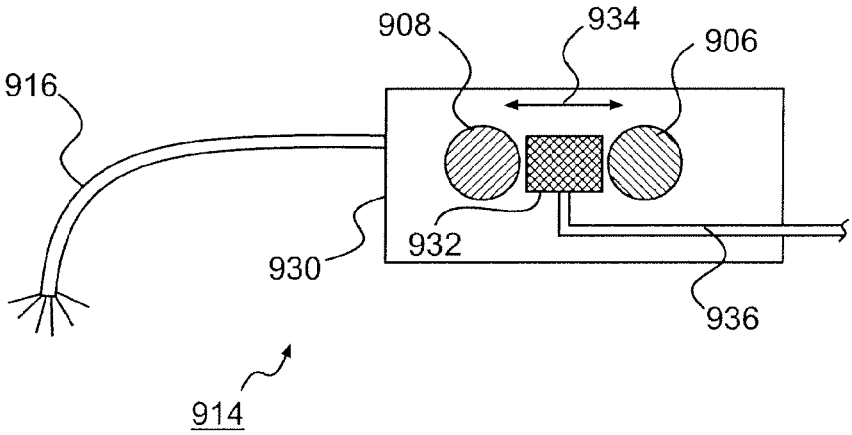
FIG. 9 is a partially schematic cross-sectional view of a body component of a sight pin, taken along line 9-9 in FIG. 8.

FIGS. 8 and 9 schematically show general features of sight pin support system 900. System 900 illustratively includes M sight pins that can be moved in a pin adjustment direction, either individually or in groups. M could be any suitable integer; due to current requirements set by various archery organizations, M could be equal to 3, 4, 5, or 7, for example.

In FIG. 8, segments 902 and 904 are parts of a support component or support structure that, in use, is mounted on an archery bow (not shown). Although various techniques could be used to mount the support component on a bow, exemplary techniques described below are suitable for an implementation that also includes features as described above.

FIG. 8 illustrates one way in which the support component that includes segments 902 and 904 could include and support other parts, illustratively including stabilizing shaft 906 and adjusting screw 908. Stabilizing shaft 906 may be implemented as a circular shaft or a square shaft. The particular arrangement of the support component with shaft 906 and screw 908 is only illustrative, and various other types of parts could be included in and/or supported on a support component in a wide variety of ways. In the illustrated example, however, shaft 906 and screw 908 extend between segments 902 and 904, and both extend through and together support M body components designated 910 through 912, with body component 910 being the 1st and with body component 912 being the Mth.

Each of body components 910 through 912 in turn supports a respective sight pin component shown at the upper side in FIG. 8. More specifically, FIG. 8 shows mth body component 914 supporting mth sight pin component 916. Like the other sight pin components supported by body components 910 through 912, component 916 has an end, illustratively the upper end, that a user of an archery bow can view while aiming the bow, such as in ways described above. Light is illustratively being emitted from the upper end of component 916, although techniques as in FIGS. 8 and 9 could be applied to other types of sight pin components including sight pins that do not emit light.

As suggested by arrows 920 and 922, body component 914 can be moved toward either of segments 902 or 904 and the directions indicated by arrows 920 and 922 are sometimes collectively referred to as a "pin adjustment direction" herein; in general, pin adjustment directions described herein are straight, but other implementations would be within the scope of the techniques described herein. Adjusting screw 908 has knob 924 mounted on one end, illustrating one way in which screw 908 could be turned in order to move body component 914 in the pin adjustment direction; in some implementations as described herein, sight pins are referred to as "micro-pins" because they can be closely spaced and very small, while knob 924 is sometimes referred to as a "micro-adjustment knob" because it can be turned to make very fine adjustments in micro-pin position. Shaft 906, in the illustrated implementation, need not be turnable in the same way that screw 908 is, and therefore can be included in, supported by, and/or attached to the support component in any suitable way.

FIG. 9 shows features of body component 914 in cross-section, and all of body components 910 through 912 could include similar features. Frame 930 serves as a pin support part that, in use, supports sight pin component 916; in exemplary implementations described herein, frame 930 and part of component 916 are integrally formed, but other support techniques could be used, such as mounting or attaching techniques. Movable part 932 is mounted on frame 930 such that part 932 and frame 930 can be moved relative to each other as indicated by bi-directional arrows 934. Control part 936 can be operated, such as by a user of the archery bow, to move movable part 932 and frame 930 relative to each other between two positions, sometimes referred to herein as first and second positions. Frame 930 and parts 932 and 936, together with other parts of a body component, could be implemented in a wide variety of specific ways, several of which are described below in relation to exemplary implementations.

In FIG. 9, movable part 932 has a first surface area disposed toward shaft 906 and a second surface area disposed toward screw 908. In general, control part 936 can be operated to move movable part 932 between its first position in which its first surface area engages shaft 906 and its second position in which its second surface area engages screw 908.

In the first position of movable part 932, its first surface area engages a pin stabilizing surface of shaft 906 sufficiently to substantially prevent movement of sight pin component 916 in the pin adjustment direction. Shaft 906 therefore serves as a part of the support component and its pin stabilizing surface extends substantially in the pin adjustment direction. As used herein, the term "pin stabilizing surface" refers to a surface that can be engaged by another surface or surface area to stabilize position of a sight pin component; in the illustrated example, the first surface area of movable part 932 engages the outer surface of shaft 906 to stabilize the position of component 916 in the pin adjustment direction and the engagement is sufficient to substantially prevent movement of component 916.

In the second position of movable part 932, its second surface area engages a screw-threaded lateral surface of screw 908 such that sight pin component 916 moves in the pin adjustment direction when screw 908 is turned. Screw 908 therefore serves as a turnable part that extends in the pin adjustment direction and has a screw-threaded lateral surface. The second surface area of movable part 932 can, for example, include ridges or other features that engage the screw-threaded lateral surface so that body component 914 moves in the pin adjustment direction in response to turning of screw 908, and sight pin component 916 in turn also moves in the pin adjustment direction.

Figure 15:
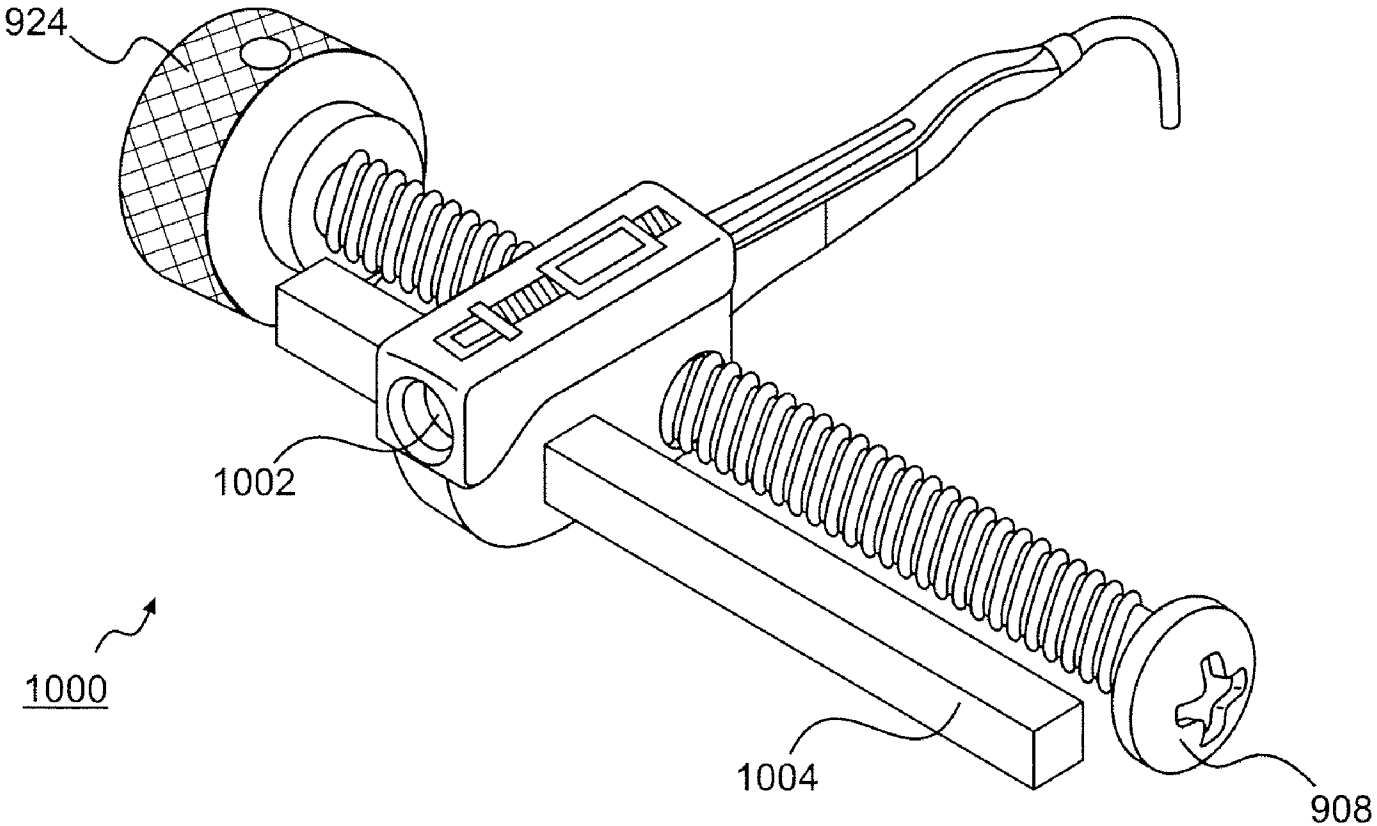
FIG. 15 is a perspective view of a portion of another article that includes a set of sight pin components, implementing features shown in FIGS. 8 and 9.
Figure 16:
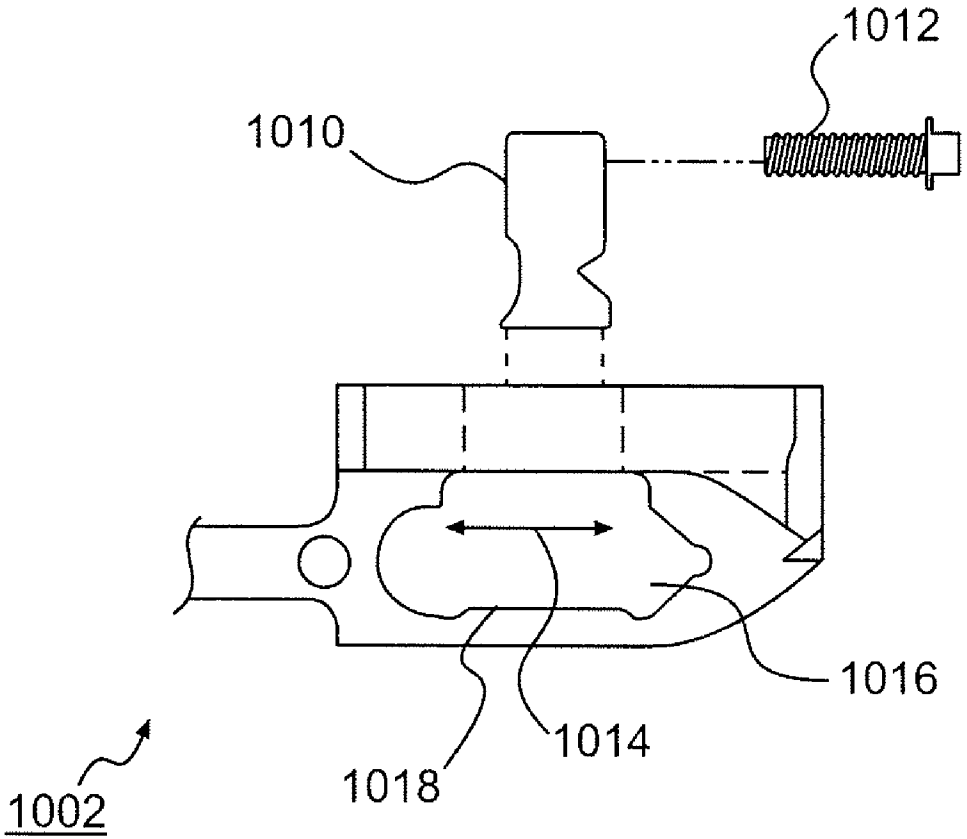
FIG. 16 is an exploded view of a sight pin body as in FIG. 15.
Figure 17:
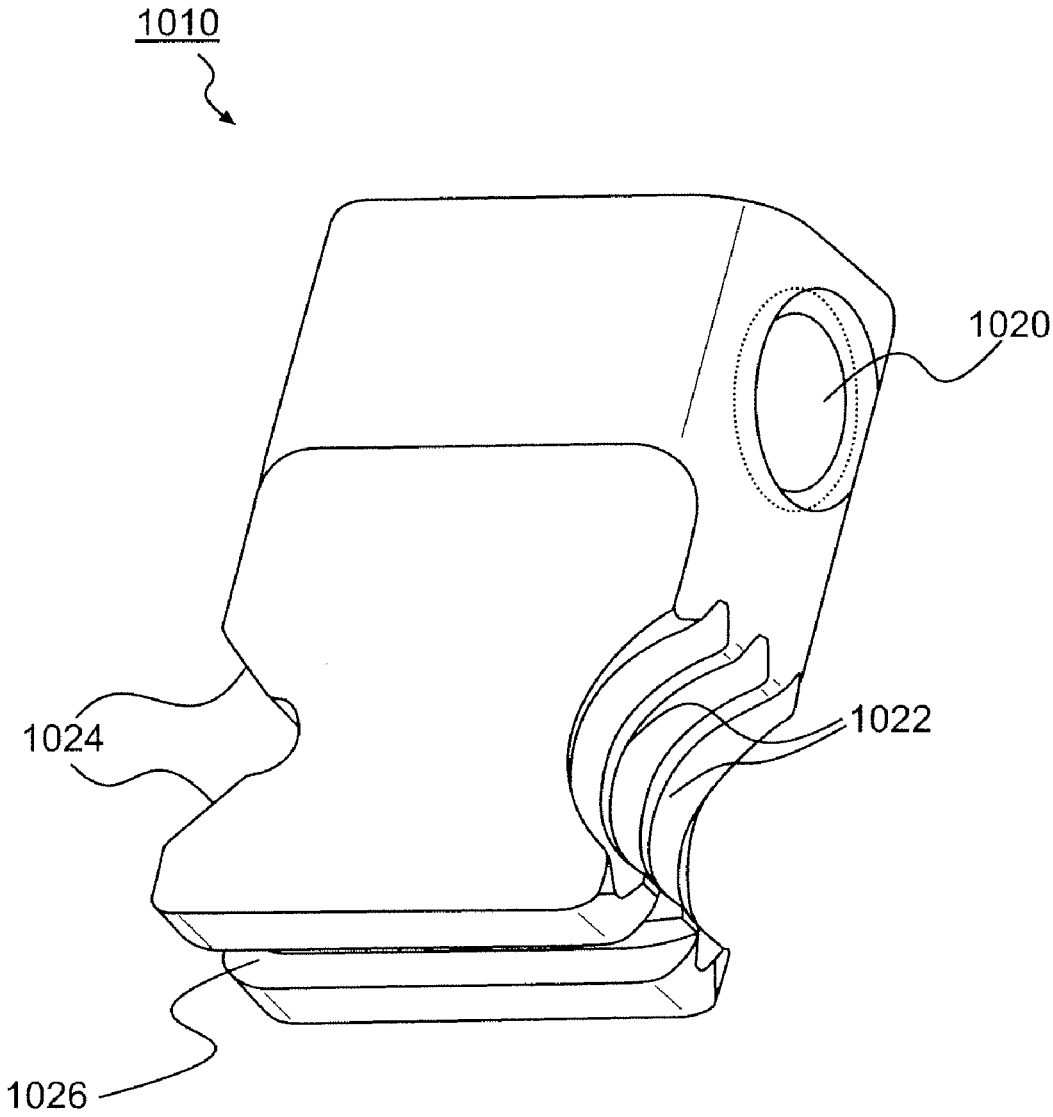
FIG. 17 is a perspective view of a slide part as in FIG. 16.

The techniques described above in relation to FIGS. 8 and 9 could be implemented in a wide variety of different ways, some of which are suggested above. FIGS. 10-14 illustrate one implementation of the general techniques in FIGS. 8 and 9, in which movable part 932 is implemented with a part that pivots. FIGS. 15-17 illustrate another implementation in which movable part 932 is implemented with a part that slides. Some parts that correspond to features in FIGS. 8 and 9 are labeled with the same reference numerals even though there may be differences in implementation from features shown in FIGS. 8 and 9.

Figure 10:
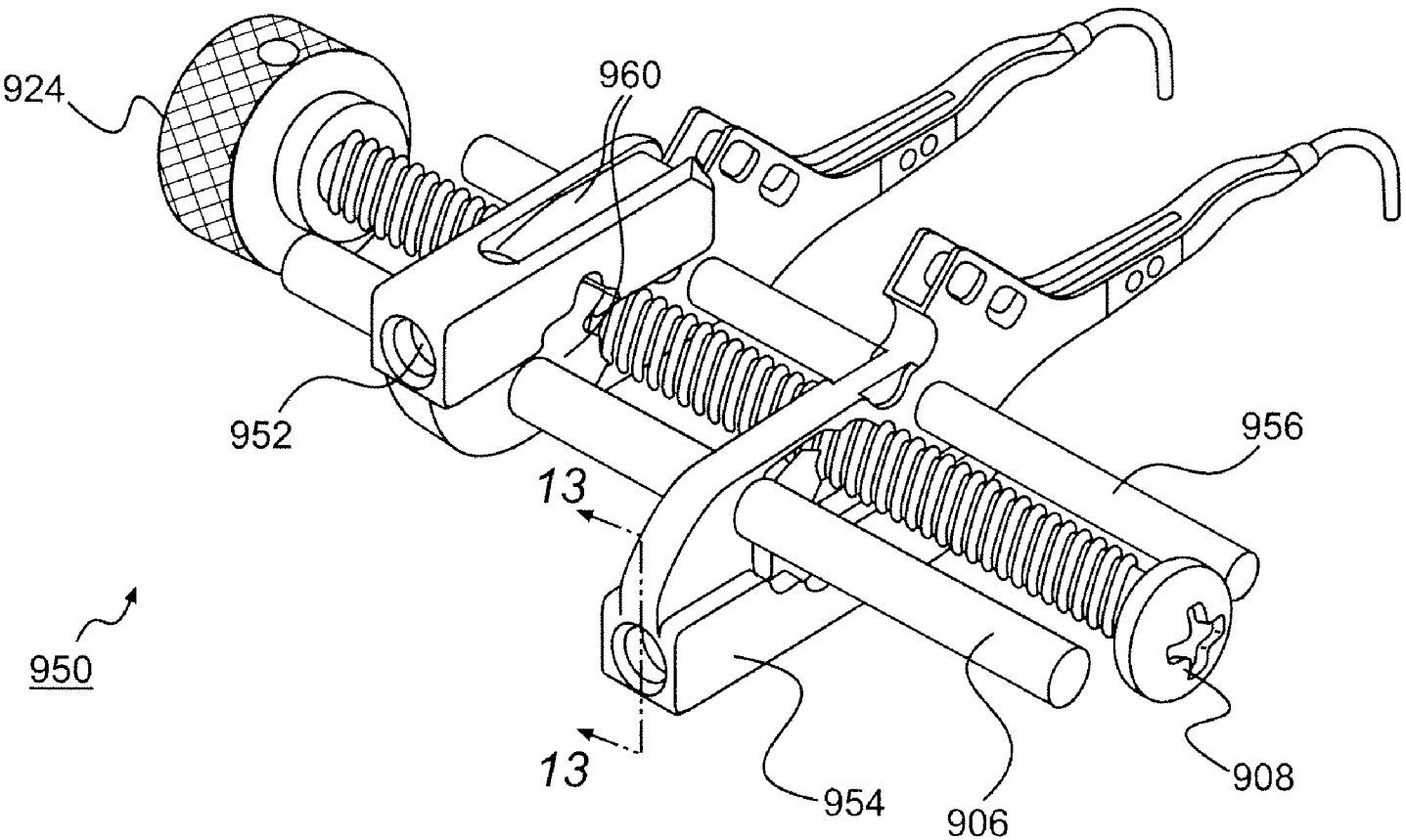
FIG. 10 is a perspective view of a portion of an article that includes a set of sight pin components, implementing features shown in FIGS. 8 and 9.

FIG. 10 shows portion 950 of an article that includes a set of sight pin components, each supported on a body component. Each body component is integrally formed, however, with part of the respective sight pin component, with sight pin bodies 952 and 954 being two of a set of sight pin bodies in the article. As shown in FIG. 10, stabilizing shaft 906 and adjusting screw 908 extend through bodies 952 and 954. In addition, guide shaft 956 also extends through respective openings in bodies 952 and 954, limiting their freedom of movement. Features of the sight pin component portions of bodies 952 and 954 can be understood from description of exemplary implementations elsewhere herein, such as in relation to FIGS. 4-7 above.

Figure 11:
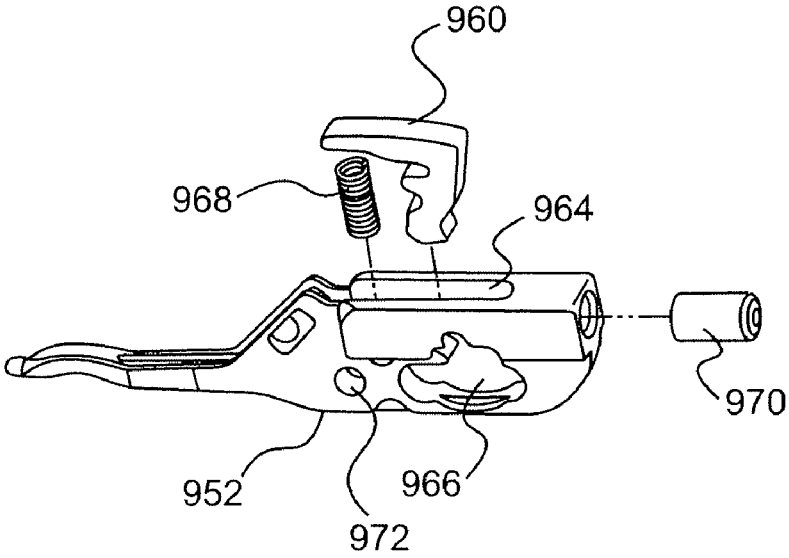
FIG. 11 is an exploded view of a sight pin body, as in FIG. 10.
Figure 12:
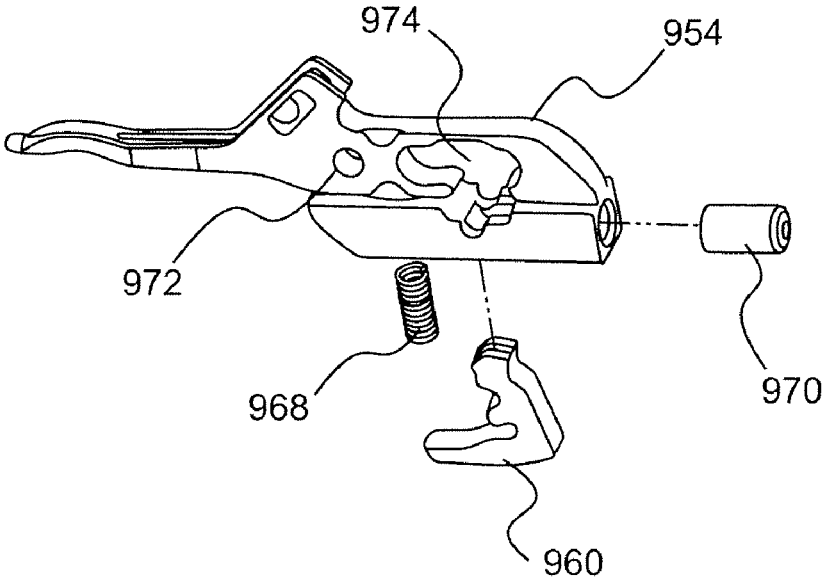
FIG. 12 is an exploded view of another sight pin body, as in FIG. 10.

FIGS. 11 and 12 show bodies 952 and 954, respectively, together with additional parts that implement features described above in relation to movable part 932 and control part 936 (FIG. 9). As suggested in FIGS. 11 and 12, bodies 952 and 954 are partially approximate mirror images of each other, as described in greater detail below. As a result, even though each of bodies 952 and 954 includes some parts that are wider than the desired minimum separation between sight pins, the wider parts of body 952 align with narrow parts of body 954, and vice versa, making it possible for bodies 952 and 954 to fit together to provide a narrower minimum sight pin separation as appropriate for micro-pins. In addition, parts that implement features of movable part 932 and control part 936 can be interchangeable, being the same in both of bodies 952 and 954.

Body 952 in FIG. 11 has a combination of openings defined therein to accommodate pivot part 960: Slot opening 964 is machined so that pivot part 960 can be inserted into body 952 through it; transverse opening 966 is machined through body 952 and serves several purposes. One purpose of transverse opening 966 is to provide regions through which shaft 906 and screw 908 extend through body 952. Another purpose is to guide the pivoting motion of pivot part 960; for this purpose, as described in greater detail below, transverse opening 966 includes a pivot point region, and is generally large enough so that pivot part 960 can pivot between its first position in which a first surface area engages shaft 906 and its second position in which a second surface area engages screw 908.

In addition, body 952 includes an opening that holds bias spring 968, which urges pivot part 960 toward its second position, against screw 908. Body 952 also has a threaded opening that receives control screw 970, which has been successfully implemented as a socket set screw with a diameter of 0.138 inch. When control screw 970 is turned in one direction, for example clockwise, it pushes pivot part 960 into its first position, against shaft 906; then, when control screw 970 is turned in the opposite direction, for example one turn counterclockwise, bias spring 968 pushes pivot part 960 back into its second position, against screw 908.

With pivot part 960 against screw 908, if screw 908 is turned, ridges or other appropriate features on the second surface area of pivot part 960 engage the threads on the lateral surface of screw 908, so that the turning of screw 908 causes body 952 together with the sight pin it supports to move in the pin adjustment direction. If body 952 meets resistance to its motion, such as if it is pushed against body 954, the turning of screw 908 does not cause damage, however, because bias spring 968 allows pivot part 960 to move away from screw 908 slightly, disengaging the second surface area from the threads of screw 908 to prevent damage. In addition, components can be chosen and/or adjusted so that a click or ratchet-like sound provides feedback to the user as screw 908 is turned in this situation.

Guide opening 972 is defined in body 952 so that guide shaft 956 can extend through body 952. The inner diameter of opening 972 is only slightly larger than the outer diameter of shaft 956, however, so that body 952 is held in a stable position in a plane perpendicular to the pin adjustment direction, preventing tipping or flipping; in a successful implementation, less than two thousandths (0.002) of an inch clearance was sufficient. As a result, if control screw 970 is in a position such that pivot part 960 is neither engaging shaft 906 nor screw 908, body 952 is stable and cannot move except in the pin adjustment direction.

Body 954 in FIG. 12 has features similar to those of body 952 as described above, including pivot part 960, bias spring 968, control screw 970, and guide opening 972. Transverse opening 974 in body 954, however, is upside down from transverse opening 966 in body 952, because of the mirror image relationship between bodies 952 and 954 described above. In other respects, the motion of pivot part 960 in relation to body 954 is under control of control screw 970 and its response to bias spring 968 is substantially the same as described above in relation to FIG. 11.

Figure 13:
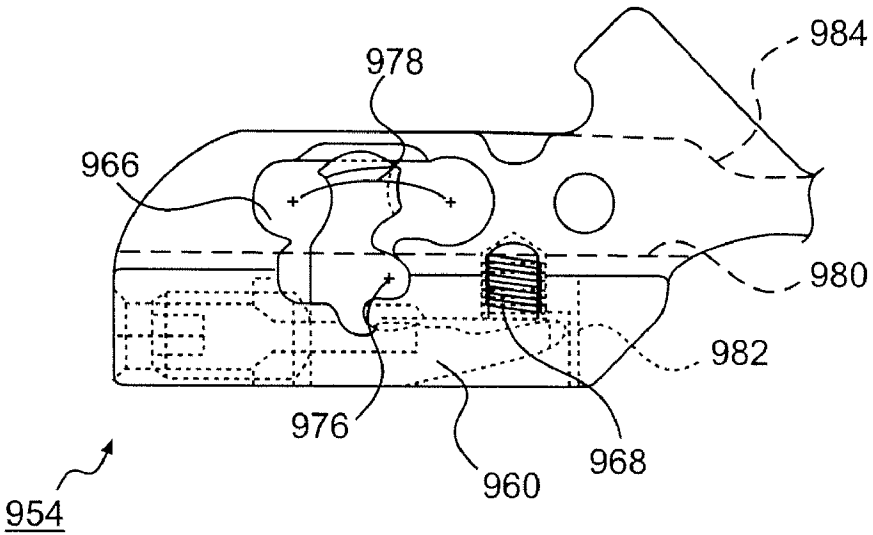
FIG. 13 is a cross-sectional view of a sight pin body, taken along line 13-13 in FIG. 10.

FIG. 13 shows a cross section of body 954 taken along the line 13-13 in FIG. 10, omitting features of the sight pin component which would appear at the right in FIG. 13. In general, features of body 954 are labeled with the same reference numerals as in FIG. 12. In addition, FIG. 13 shows pivot point 976, which receives a knob or bump on a side of pivot part 960, allowing pivot part 960 to pivot as indicated by bi-directional arrow 978. Spring 968 provides pressure that helps to hold the knob or bump in place at pivot point 976. If control screw 970 is appropriately structured, one turn changes pivot part 960 between engaging shaft 906 and engaging screw 980, and vice versa, allowing an easy transition when pin adjustment is desired.

FIG. 13 also shows dashed line 980, an axis of symmetry around which some features of bodies 954 and 952 are approximate mirror images of each other, allowing them to fit more closely against each other than they could otherwise. For example, the lower region of body 954, as shown in FIG. 12, is wider than the upper region, to allow for the widths of pivot part 960, spring 968, and screw 970 within it. Therefore, a mirror image about line 980 would be wider in its upper part and thinner in its lower part, as with body 952 (FIG. 11). As a result, the effective width of two such bodies when against each other will be one half the sum of the width of the wider part and the width of the narrow part, somewhat less than the width of the wider part.

FIG. 13 also shows, however, that mirror image symmetry is not complete: Dashed line 982 shows approximately where the wider part of body 952 (FIG. 11) ends, so that it is somewhat shorter in the forward direction than the wider part of body 954; also, dashed line 984 shows the outline of the lower side of the reflected position of the narrow part of body 952, which is somewhat different than the upper edge of body 954, in part because bodies 952 and 954 support their respective sight pins at different levels relative to guide shaft 956, as can be seen by comparing FIGS. 11 and 12. In other words, even though the approximate mirror image symmetry of bodies 952 and 954 allows for adjacent sight pins to be closer, adjacent sight pins are at different levels relative to each other in this implementation.

Figure 14:
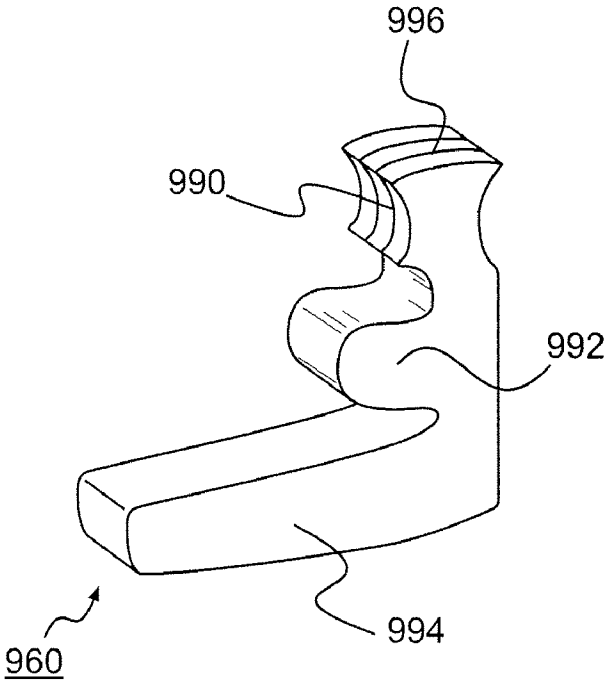
FIG. 14 is a perspective view of a pivot part as in FIGS. 11-13.

FIG. 14 shows a side view of an implementation of pivot part 960, showing features of the side disposed toward screw 908 (FIG. 10); a pivot part with features substantially as in FIG. 14 has been implemented in stainless steel. As shown in FIGS. 11 and 12, pivot part 960 has three regions in which it extends in a "forward direction", i.e., a direction toward the sight pin supported by either of bodies 952 and 954. The upper region in FIG. 14 includes the second surface area with ridges 990, spaced and otherwise structured so that turning of screw 908 causes pivot part 960 to move in the pin adjustment direction together with the body in which it is positioned. Directly behind ridges 990, pivot part 960 has a smooth surface area shaped to fit snugly around shaft 906, stabilizing position of the respective sight pin. Below ridges 990 is knob 992, shaped and sized to fit into pivot point 976 (FIG. 13), allowing pivot part 960 to pivot as described above. At the bottom in FIG. 14 is bias arm 994, which extends to at least the position of spring 968; bias arm 994 receives bias pressure from spring 968 and, in response, causes movement of pivot part 960 about pivot point 976 as screw 970 is turned to allow such movement. On the upward side of pivot part 960 are grooves 996 which can fit over one or more ridges on body parts 952 and 954, on a facing surface within opening 966, guiding pivot part 960 and prevent relative movement between the body part and its pivot part 960 in the pin adjustment direction.

FIG. 15 shows portion 1000 of another article that includes a set of sight pin components, each supported on a body component, but with only one sight pin shown. As in FIG. 10, each body component is integrally formed with part of the respective sight pin component, with sight pin body 1002 being one of the sight pin bodies in the article. As shown in FIG. 15, square stabilizing shaft 1004 and adjusting screw 908 extend through body 1002. Some features of the sight pin component portion of body 1002 can be understood from the description of exemplary implementations elsewhere herein, such as in relation to FIGS. 4, 6, and 7 above.

FIG. 16 shows a portion of body 1002, together with additional parts that implement features described above in relation to movable part 932 and control part 936 (FIG. 9), which are implemented by slide part 1010 and control screw 1012, respectively. Body 1002 has a combination of openings defined in it to accommodate slide part 1010 and control screw 1012: Slot openings of appropriate widths are machined in the upper side of body 1002 so that slide part 1010 and control screw 1012 extending through it can be inserted into body 1002 and so that slide part 1010 can move in the directions indicated by bi-directional arrow 1014 in response to turning of control screw 1012; transverse opening 1016 is machined through body 1002 and serves several purposes. One purpose of transverse opening 1016 is to provide regions through which shaft 1004 and screw 908 extend through body 1002. Another purpose is to guide the sliding motion of slide part 1010; rail 1018 in the lower part of transverse opening 1016 also assists in this purpose.

FIG. 17 shows slide part 1010 in greater detail. At the upper end of slide part 1010 is threaded opening 1020, through which control screw 1012 extends such that turning of screw 1012 causes slide part 1010 to move in one of the directions indicated by arrows 1014. When slide part 1010 moves toward screw 908, curved ridges 1022 engage the threaded lateral surface of screw 908 so that body 1002 can be moved in the pin adjustment direction by turning screw 908. Conversely, when slide part 1010 is moved against shaft 1004 by turning screw 1012, angled surfaces 1024 engage surfaces of shaft 1004, stabilizing the position of body 1002 in the pin adjustment direction. While body part 1010 is being moved in either direction, its sliding movement is controlled by contact between groove 1026 in its bottom side and rail 1018 in the lower side of transverse opening 1016 (FIG. 16).

The implementations described above in relation to FIGS. 8-17 are merely illustrative, and general features shown in FIGS. 8 and 9 could be implemented in many other ways within the scope of the invention. For example, movable parts and control parts could be implemented in many other ways, and a set of sight pins could be adjustably supported on more or different shafts, screws, and so forth. In general, the various parts shown could be implemented with various materials and dimensions. In exemplary implementations, for example, bodies 952, 954, and 1002, pivot part 960, and slide part 1010 have been implemented in aluminum alloy material, but various other materials could be used. Spring 968 has been implemented with a wire zinc-plated spring, such as with an outside diameter of 0.094 inches, a length of 0.25 inches, and a wire diameter of 0.014 inches. Screw 970 can be implemented with a stainless steel screw with a hex-shaped opening so that it can be turned with a small hex wrench. Screw 1012 can similarly be implemented with a screw that can be turned with a hex wrench.

Figure 18:
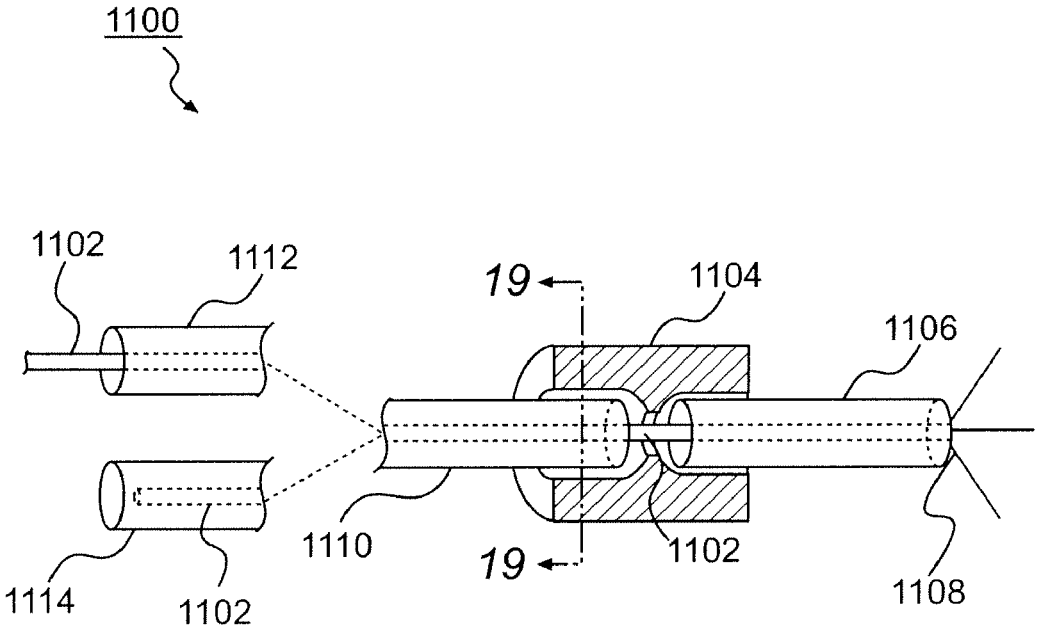
FIG. 18 is a partially schematic view of a portion of an article in which light-transmissive tubing surrounds an optical fiber along most of its length, which could be used in an archery sight as in FIG. 1.
Figure 19:
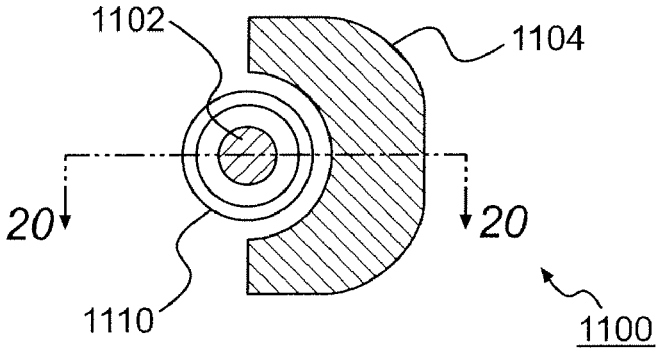
FIG. 19 is a cross-sectional view taken along line 19-19 in FIG. 18.
Figure 20:
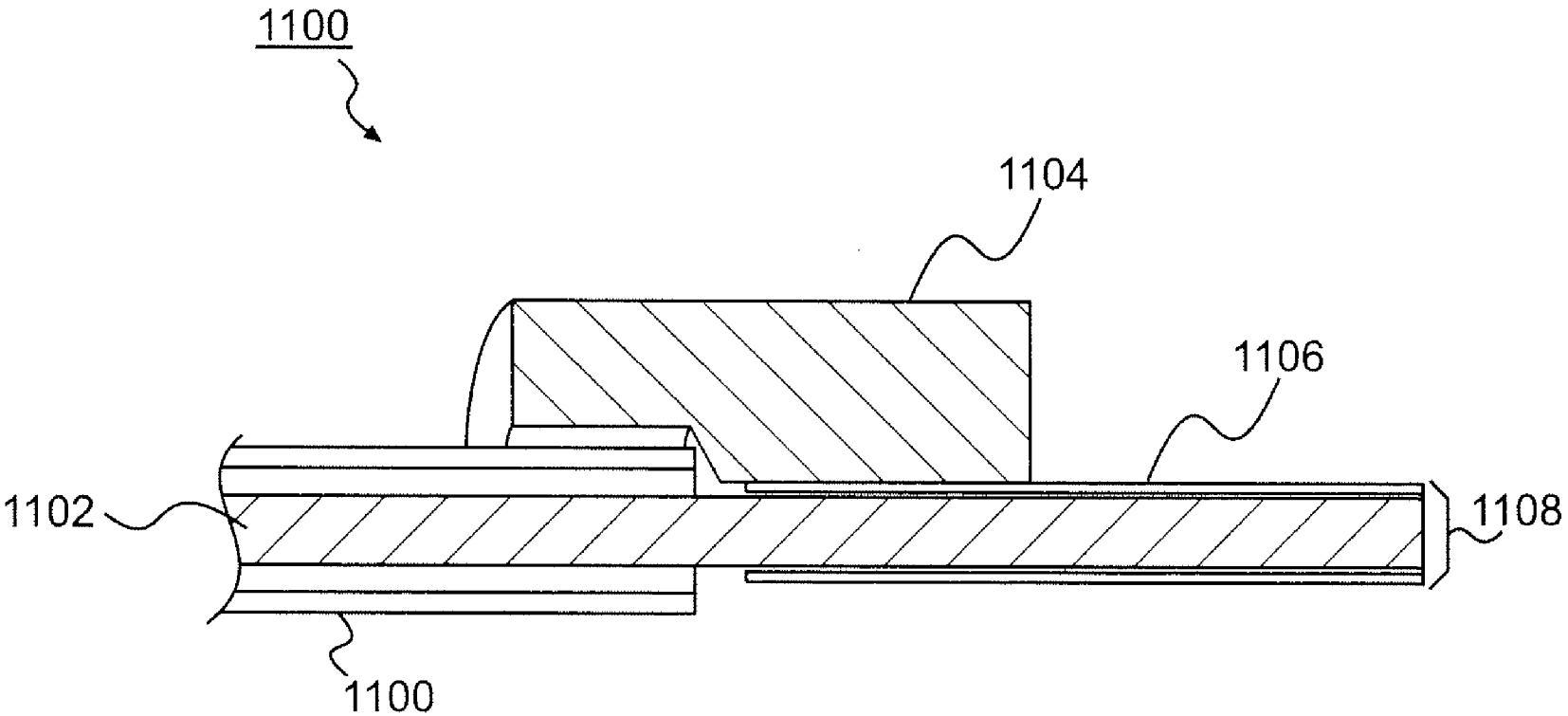
FIG. 20 is a cross-sectional view taken along line 20-20 in FIG. 19.

FIGS. 18-20 show portion 1100 of an article in which a sight pin component is supported on a support component that, in use, is mounted on an archery bow; more specifically, portion 1100 is part of such a sight pin component. The sight pin component, support component, and mounting on the bow could be implemented in one of the ways described above or in any of various other ways, some of which are suggested herein. For example, the sight pin component and support component could be implemented in an archery sight that includes a sight frame component such as a scope, through or within which an archer can view a set of one or more sight pins.

General features shown in FIGS. 18-20 are highly schematic and not to scale, but illustrate relations between parts and components of a sight pin component along the length of an optical fiber set 1102 that includes one or more optical fibers. As used herein, the term "optical fiber" includes any of various kinds of fibers or filaments of light-transmissive dielectric material, such as glass or plastic, that guide light; it is foreseeable that additional kinds of optical fibers within this definition will be developed in the future, such as with different materials, different shapes or sizes, different cladding structures, and so forth, and future developed kinds of optical fibers are intended to be included in the above definition to the extent they are suitable for use in the techniques described herein.

The sight pin component that includes portion 1100 also includes body part 1104, viewed in FIG. 18 from an open side for illustrative purposes, but which could instead extend around and enclose portions of other parts, as described elsewhere herein for exemplary implementations. In the illustrated example, body part 1104 serves as a sight pin body component.

On the right side of body part 1104 in FIGS. 18 and 20, tube 1106 serves as a tube-like part that has two open ends and an inner opening that extends between the open ends; tube 1106 is supported on body part 1104 at a first open end (its leftward open end in FIGS. 18 and 20) and has a second open end (its rightward open end in FIGS. 18 and 20) at sight pin end 1108. Tube 1106 can be held in position within body part 1104 in various ways, such as with bending techniques described above in relation to FIG. 4.

Body part 1104 also has an exit opening defined in it, extending between the first open end of tube 1106 and the body part's exterior, illustratively at left in FIGS. 18 and 20. Fiber set 1102 thus extends from sight pin end 1108 through the inner opening of tube 1106 to body part 1104 and exits through the exit opening to the exterior. Fiber set 1102 therefore extends an exterior length from the exit opening.

Fiber set 1102 has light-receptive lateral sides, e.g., lateral sides of individual fibers in set 1102. Optical fibers in set 1102 are structured so that light received through the lateral sides is at least partially propagated to and emitted from sight pin end 1108. Under suitable conditions, a user of an archery bow on which the sight pin component is supported can view sight pin end 1108 while aiming the bow and see the emitted light from set 1102, as described above.

Due to fragility of currently available optical fibers, however, there is a risk of bending, breakage, or other damage, especially if fibers in set 1102 are subject to bending, vibration, or other mechanical stresses during manufacture or use of the sight pin component. To alleviate this and other problems, portion 1100 includes flexible tube 1110, an example of a flexible, light-transmissive tubing part that surrounds optical fibers in set 1102. Because it surrounds the optical fibers, tube 1110 protects them from bending, breakage, and other damage in most of the length in which the fibers are not surrounded by other parts, e.g., body part 1104 and tube 1106 in FIGS. 18-20. Because the fibers are protected, a smaller fiber appropriate for a micro-pin can be used than would otherwise be required to withstand mechanical stresses.

As illustrated by exemplary end segment 1112, one or more fibers in set 1102 can extend slightly beyond the free end of tube 1110, an example in which tube 1110 surrounds nearly all of the exterior length of set 1102, with "nearly all" used herein to mean approximately 90% of the exterior length or more; for example, in exemplary implementations described herein, all except a relatively short length such as approximately an inch or less is surrounded. As illustrated by exemplary end segment 1114, on the other hand, tube 1110 can extend to or beyond the ends of all fibers in set 1102, an example in which tube 1110 surrounds all of the exterior length of set 1102.

Both of the illustrated examples are also examples in which flexible tubing surrounds set 1102 "along substantially all" of the exterior length of set 1102, i.e., at least 90% covered; it is also accurate that tube 1110 surround set 1102 "along at least a majority" of the exterior length, meaning that set 1102 is surrounded along more than 50% of the exterior length. In such implementations, a part of the exterior length of one or more optical fibers that implement set 1102 extend through a region in which they receive light, also referred to herein as a "light-receiving region". In some exemplary implementations described herein, the exit opening is a slot in a surface of a sight pin body component that implements body part 1104; as used herein, the term "slot" means an opening or groove that is relatively narrow compared to its length. In other words, the fibers extend through the light-receiving region and also through the slot and through a tube implementing tube-like part 1106; if tube 1110 engages the slot, tube 1110 could surround at least a majority of set 1102, or even substantially all of set 1102, from where tube 1110 engages the slot to the light-receiving region, and even through the light-receiving region in some implementations.

Parts and components as shown in FIGS. 18-20 could be implemented in various ways with various materials and with various shapes and sizes. In current successful implementations, several constraints are satisfied to obtain emitted light at sight pin end 1108 that is visible to a "normal vision user", meaning a user whose vision, whether corrected or uncorrected, is within the generally accepted normal range: Tube 1110 is sufficiently light-transmissive; the length of set 1102 within the light-receiving region is sufficient; the optical fibers in set 1102 are structured; and tube 1110 receives sufficient light, e.g., under normal daylight conditions. Normal daylight conditions generally refers to conditions where there is sufficient natural ambient light for a user to see clearly without the need for artificial light, such as during daytime hours between sunrise and sunset. As will be seen from exemplary implementations described below, light received by tube 1110 can depend on other features of an archery sight that includes, e.g., the size and light-transmissive characteristics of a protective cover.

FIG. 5, described above in relation to other features, shows tube 1120, an implementation of flexible tube 1110 as in FIGS. 18-20, and sight pin 106, which includes a part implementing body 1104 as in FIGS. 18-20. As can be seen, one end of tube 1120 is within sight pin 106, visible through openings in the sides of sight pin 106. The opening defined in sight pin 106 that contains tube 1120 implements the exit opening described above.

Figure 21:
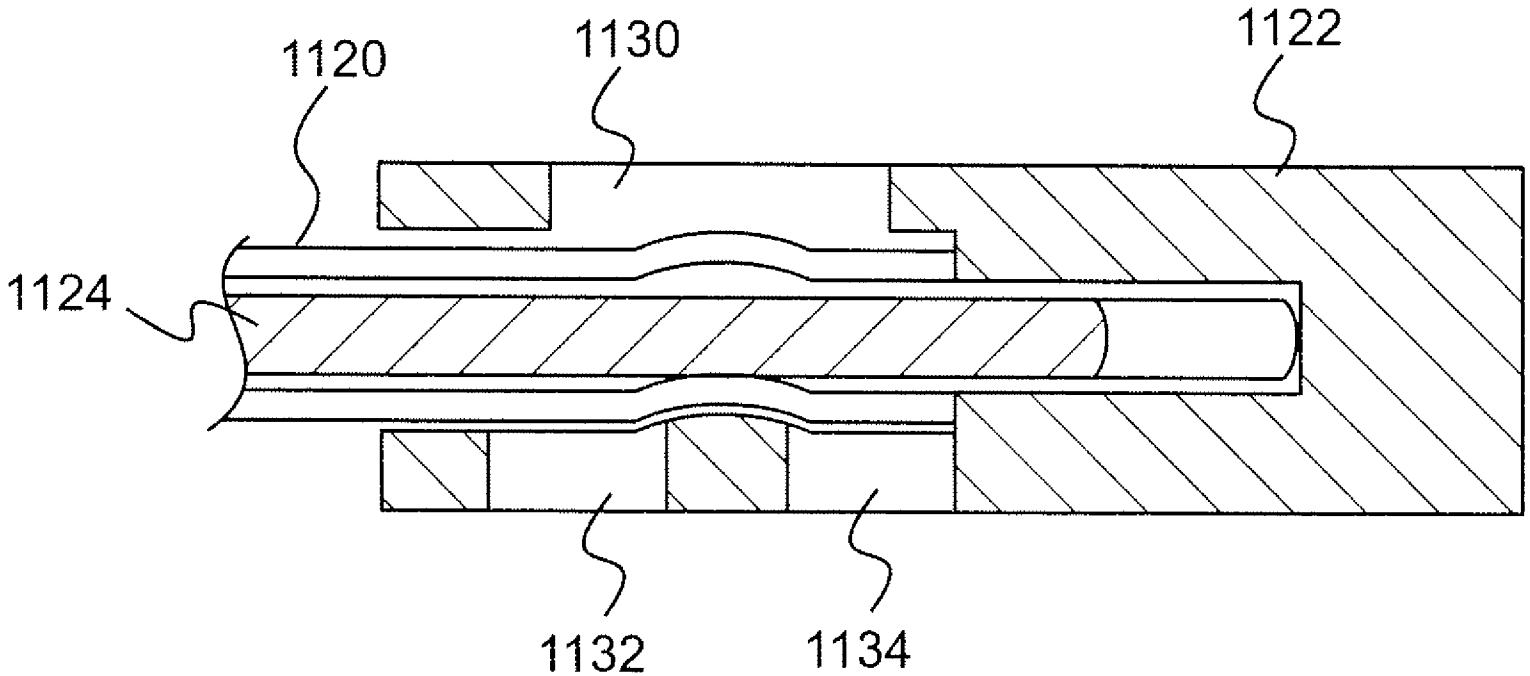
FIG. 21 is a cross-sectional view taken along line 21-21 in FIG. 5.

FIG. 21 illustrates features of sight pin 106 with tube 1120 inserted into the slot in portion 1122 of the body of sight pin 106 and with optical fiber 1124 then threaded through tube 1120, through sight pin 106, and through tube-like part 328 as described above. As it is inserted, tube 1120 engages parts of portion 1122 along the slot, so that tube 1120 may be said to "engage" the slot. More generally, tube 1120 could engage any appropriate engagement surface region of portion 1122, whether a portion that bounds an exit opening as in FIG. 21 or a part near the exit opening; tube 1120 might even extend onto or around an engagement surface portion. Because tube 1120 engages an engagement surface region that bounds or is near the exit opening, greater protection is provided to a fiber or set of fibers that extend between tube 1120 and portion 1122, because they are less exposed. This protection is even greater if tube 1120 is somehow held in place by the engagement.

To help hold tube 1120 in place after it is inserted, offset openings 1130, 1132, and 1134 are machined from the sides of sight pin 106, providing a slightly serpentine path for tube 1120 to follow as it is inserted. In other words, the depth of opening 1130 is small enough that the wall of portion 1122 between openings 1132 and 1134 causes tube 1120 to bulge slightly toward opening 1130 as it is inserted, so that tube 1120 is slightly caught and held in place and cannot easily be pulled back out after insertion. Various other combinations of openings could be used to engage tube 1120, and other techniques could be used to hold it inside the exit opening, such as various forms of attachment that might be used.

In addition, in FIG. 5, dashed line 1140 shows the boundary to which a woodruff cutter machines part of the exit opening through which tube 1120 is inserted; dashed lines 1142 and 1144 show boundaries of opening 1130, and dashed line 1146 shows another boundary to which a woodruff cutter machines part of the exit opening, a part that is narrower so that tube 1120 is stopped at the right side of opening 1134, but that is shaped so that fiber 1124 can be threaded through and extend within sight pin 106 from the end of tube 1120 to where it enters tube-like part 328. At its rightward end in FIG. 5, dashed line 1146 forks in two, illustrating how the opening can be machined differently on its two lateral sides, e.g., one on the same side as opening 1130 and the other on the same side as openings 1132 and 1134, so that one side provides a stop for a smaller diameter tube-like part 328 when inserted as described above in relation to FIG. 7.

In successful implementations, tube 1120 has been implemented with a suitable clear, flexible Tygon® polymer tubing such as from Saint-Gobain Performance Plastics Corporation, but other similar light-transmissive, flexible tubing could be used; a possible advantage of clear Tygon® tubing is that it may provide internal reflection that effectively increases light transmission efficiency by increasing the amount of light entering light-receptive lateral surfaces of optical fibers inside it, which in turn increases the amount of emitted light at the sight pin end. Implementations in which set 1102 includes a single optical fiber with outer diameter between approximately nine and nineteen thousandths (0.009-0.019) of an inch have been successfully assembled by first threading the fiber through Tygon® tubing, such as with outside diameter of seventy thousandths (0.070) of an inch and inner diameter of forty thousandths (0.040) of an inch, then inserting the Tygon® tubing into the slot in sight pin 106 as far as possible, and then pushing the fiber through sight pin 106 and tube-like part 328 until the fiber reaches the sight pin end. The end of the fiber at the sight pin end is then melted to obtain an appropriate light-emitting surface that appears as a sight point to an archer.

Figure 22:
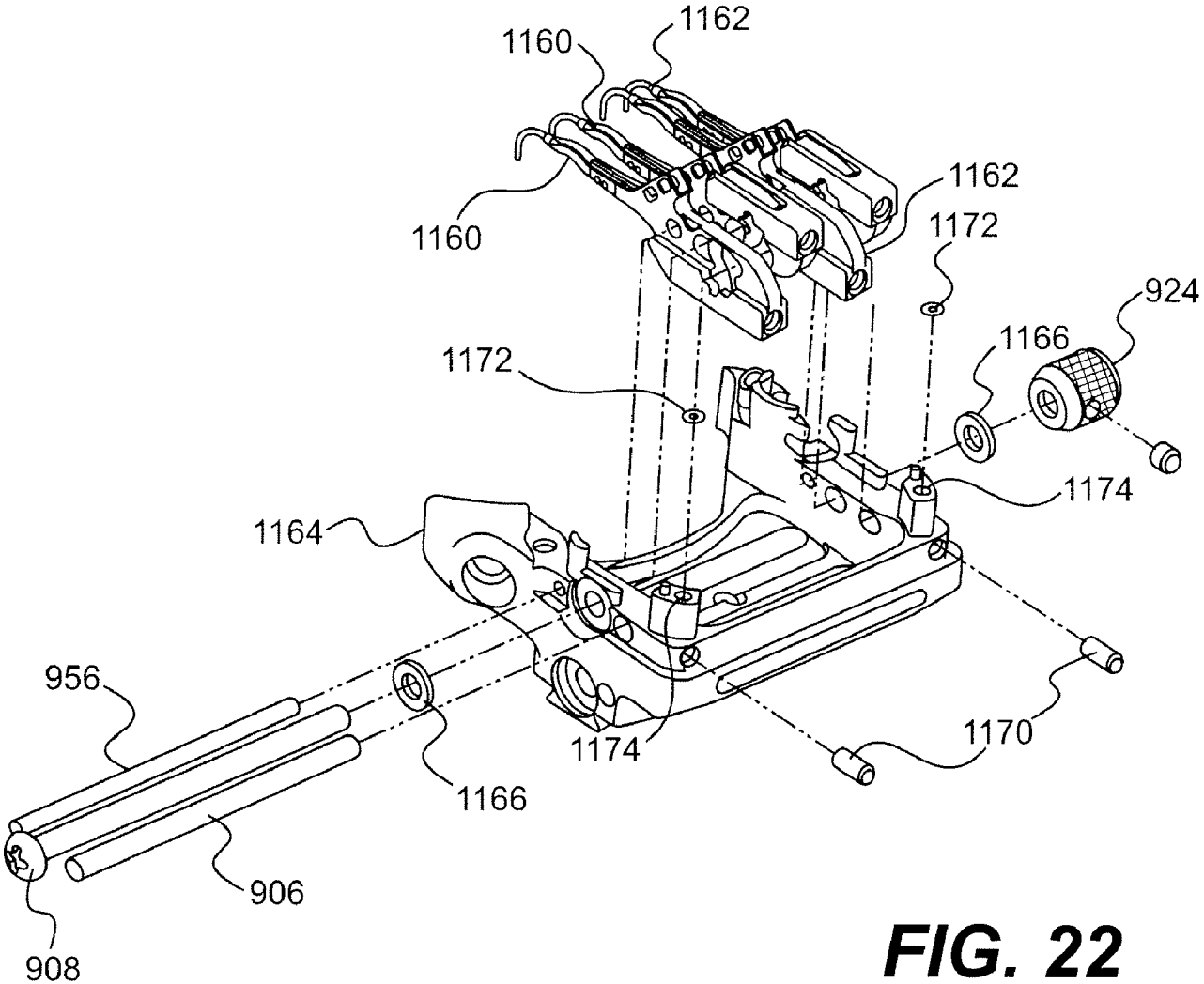
FIG. 22 is an exploded view of a partial assembly of an archery sight as in FIG. 1.
Figure 23:
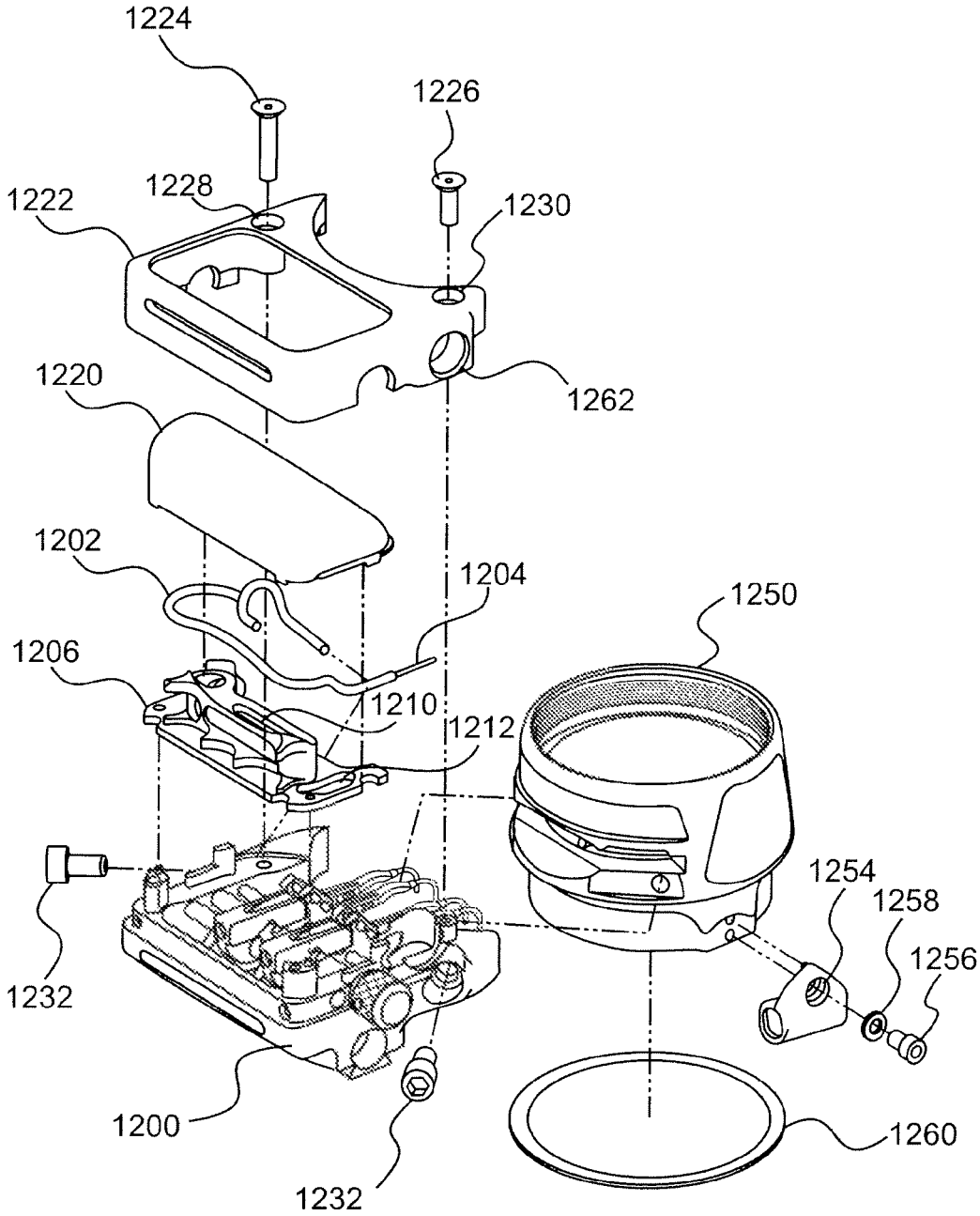
FIG. 23 is an exploded view of a scope assembly that includes the partial assembly as in FIG. 22.
Figure 24:
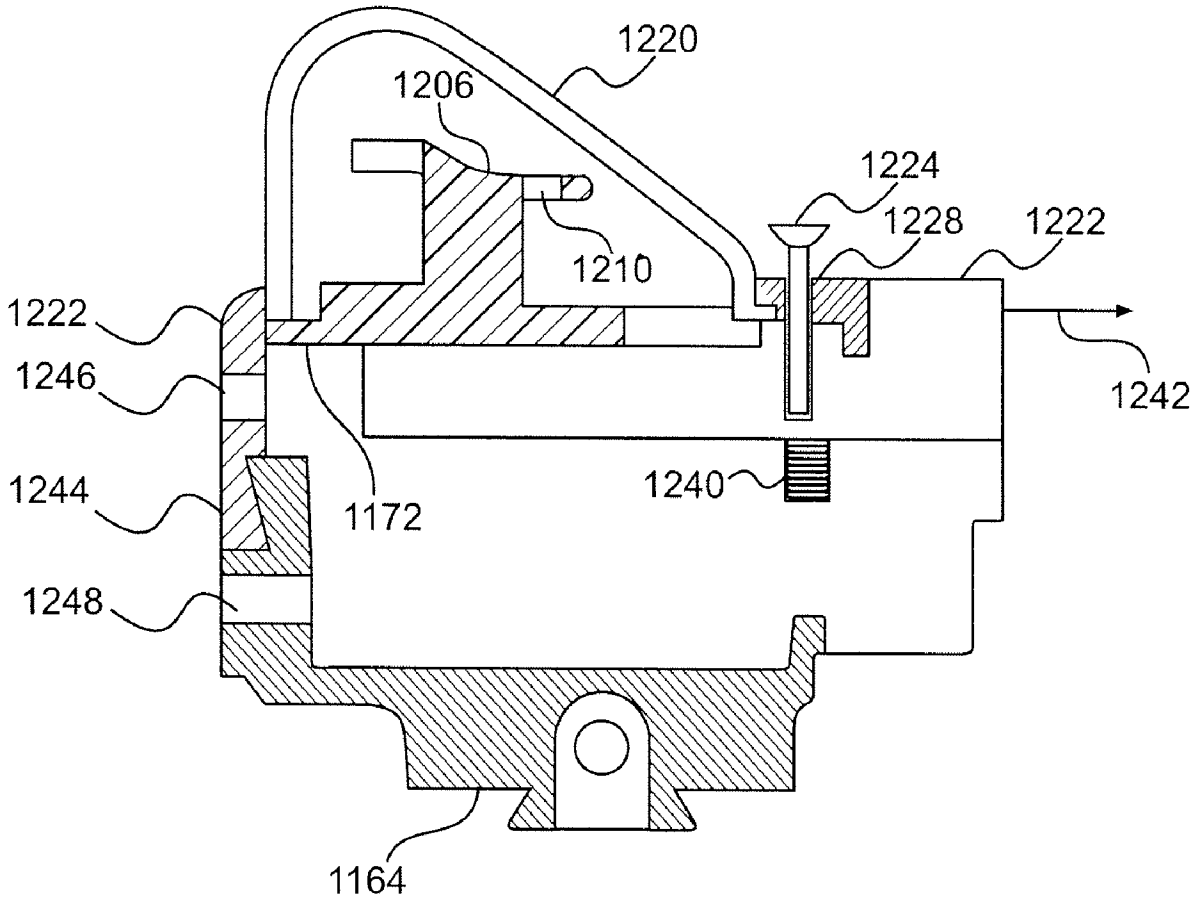
FIG. 24 is a schematic cross-sectional view of a scope assembly as in FIG. 23.
Figure 25:
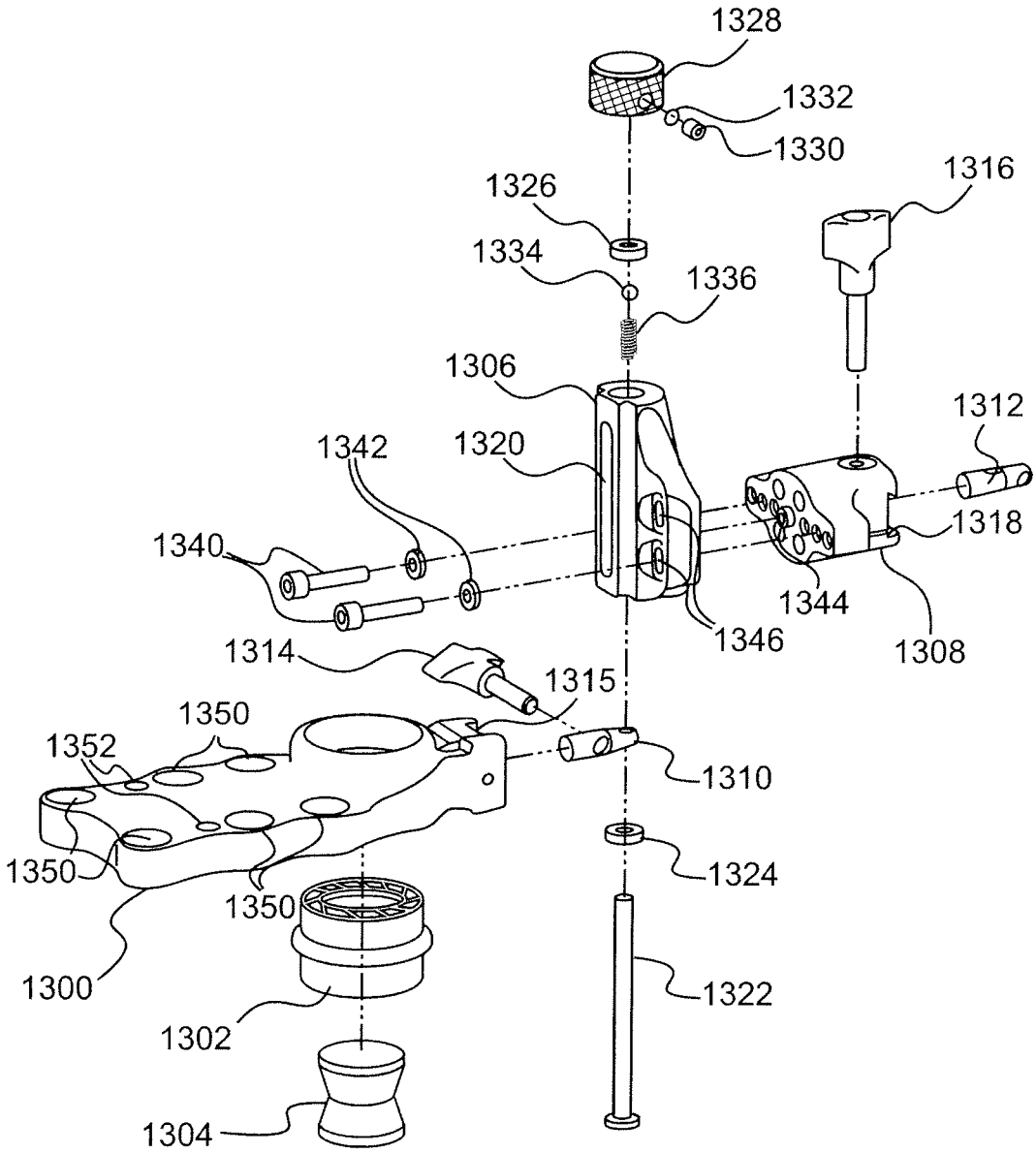
FIG. 25 is an exploded view of a bow mount assembly of an archery sight as in FIG. 1.
Figure 26:
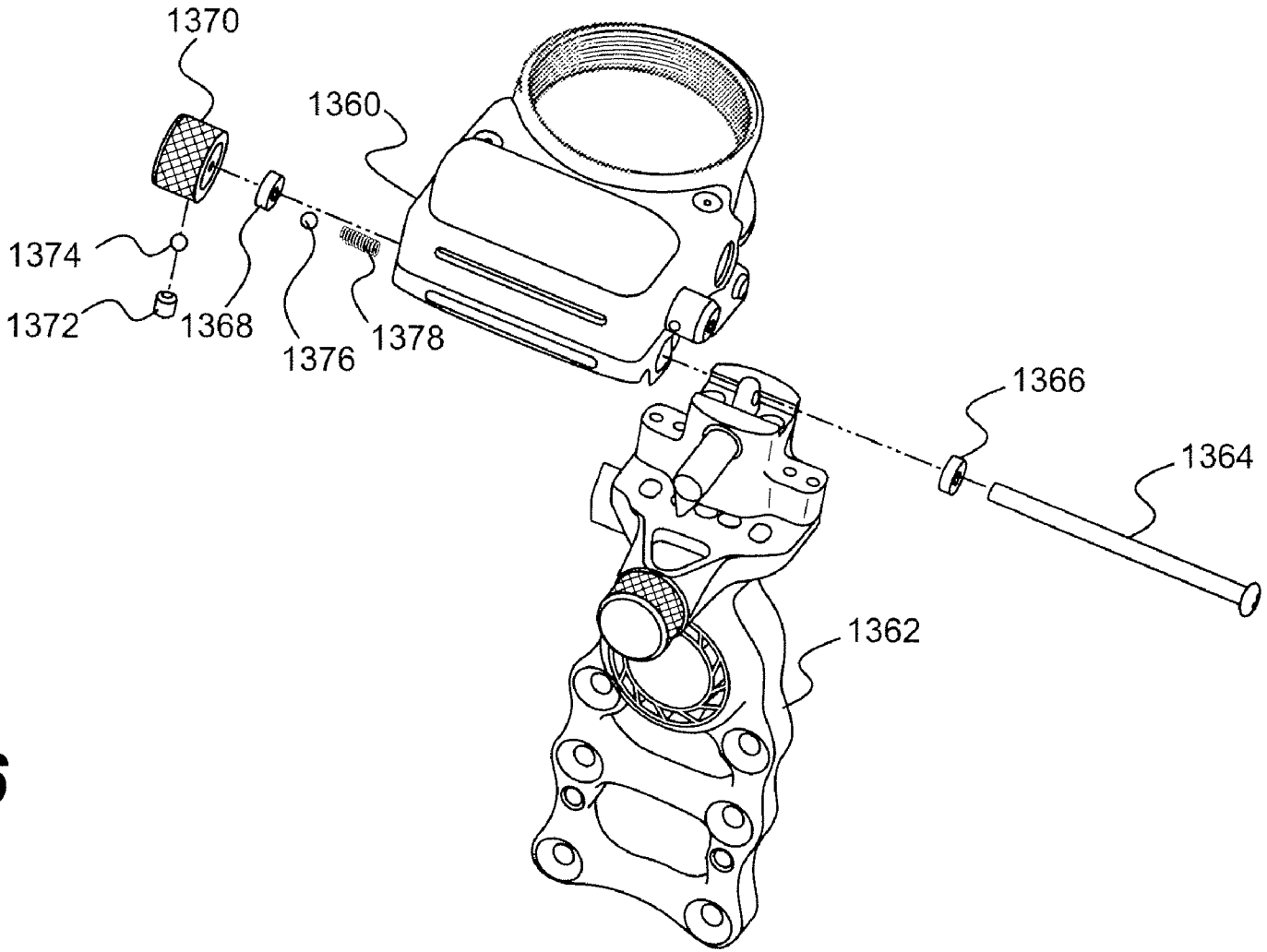
FIG. 26 is an exploded view of an archery sight that includes a scope assembly as in FIGS. 22-24 and a bow mount assembly as in FIG. 25.

FIG. 22 shows parts that can be assembled to produce a partial assembly that includes a set of sight pin body components supported on part of a support structure, ready for insertion of a light-transmissive flexible tube and threading of an optical fiber through each body component, such as in the manner described above. FIG. 23 shows how a partial assembly produced from parts as in FIG. 22 could further be assembled with other parts to produce a scope assembly that also encloses a light-receiving region; FIG. 24 shows in greater detail how parts enclosing a light-receiving region could be held together in a way that damps vibration. FIG. 25 shows parts that can be assembled to produce a bow mount assembly, and FIG. 26 shows how a scope assembly produced as in FIG. 23 and a bow mount assembly produced as in FIG. 25 could further be assembled with other parts to produce an assembled archery sight product with features as in FIG. 1. Parts shown in FIGS. 22-26 are substantially the same as an implementation that has been successfully assembled and used, and some parts have the same reference numerals as parts described above to which they are similar.

In the illustrated example, the set of sight pin body components includes four bodies, two with features described above in relation to body 952 and two with features described above in relation to body 954, with the two types alternating to allow adjacent body components to interfit, allowing reduced spacing between their respective sight pin ends. Two bodies 1160, one like body 952 and one like body 954, illustratively have larger diameter tube-like parts, indicating that they are suitable for optical fibers having diameters of nineteen thousandths (0.019) of an inch; two bodies 1162, again one like body 952 and one like body 954, illustratively have smaller diameter tube-like parts, suitable for optical fibers having diameters of nine thousandths (0.009) of an inch. Fiber diameter can be determined by customer preference, with a customer being able to choose an archery sight product with fibers of a preferred diameter; although the set of body components in FIG. 22 includes bodies suitable for two different fiber sizes, a more typical set would include bodies that are all suitable for the same size, in this case either nine or nineteen thousandths of an inch. Also, colors of light emitted by fibers can be presented in a sequence that assists the archer in identifying each fiber, such as alternating green, red, and yellow light-emitting fibers, or any other suitable combination.

As described above in relation to FIG. 10, bodies 1160 and 1162 are supported on stabilizing shaft 906, adjusting screw 908, and guide shaft 956, each of which is in turn supported on elevation housing or housing part 1164. Elevation housing 1164 could be implemented in a wide variety of ways, with various production techniques and with various shapes, sizes, and materials; in the illustrated exemplary implementation, housing 1164 has suitable openings for shaft 906, screw 908, and shaft 956. For example, shafts 906 and 956 can be two (2.0) inch long stainless steel dowel pins, such as one-eighth (0.125) and three thirty-secondths (0.0938) of an inch in diameter, respectively; each shaft can be inserted through one side of housing 1164, and, if necessary, its ends could be expanded, such as by flattening or another suitable operation, to hold it in place. Screw 908 can be a pan head #6-32 size Phillips screw, 2.25 inches long and 0.138 inch in diameter, with one of washers 1166 at each end; after screw 908 is inserted through one of washers 1166, through housing 1164, and through the other of washers 1166, knob 924 for micro-adjustment can be attached to its end, held in position by set screw 1168. Stabilizing screws 1170 can be tightened against shaft 906 to hold it firmly in place, and a similar technique could be used to hold shaft 956 in place if necessary.

Various surfaces of housing 1164 are shaped and sized to provide a number of other openings, indentations, posts, pillars, walls, alignment knobs and holes, and so forth for connecting to other parts during subsequent assembly operations. For example, O-rings 1172 are inserted into indentations 1174 in pillars at two corners of housing 1164, and later play a role in securing parts that enclose the light-receiving region, as described below in relation to an exemplary implementation. Also, the lower surface of housing 1164, not visible in FIG. 22, could have markings on it for use in elevation adjustment.

FIG. 23 shows partial assembly 1200 produced as described in relation to FIG. 22, together with other parts that are attached to it to produce a scope assembly. Among the first parts that are attached are a set of light-transmissive, flexible tubes; the set includes a respective tube for each sight pin body component, with one sight pin body component's tube 1202 being illustratively shown. In the illustrated implementation, tube 1202 contains optical fiber 1204, such as a single fiber or a number, e.g., 3-5, of twisted fibers with a suitable diameter as described above, and tube 1202 extends through and around features of base part 1206.

Various assembly techniques could be applied to tube 1202, fiber 1204, and base part 1206. For example, if optical fiber 1204 is fed from a machine that includes a reel of optical fiber (not shown), one end of tube 1202 can be pulled over and onto the leading end of the fiber, which is then fed into the central opening of tube 1202 until the fiber extends through the full length of tube 1202. Then, the opposite end of tube 1202 can be inserted into the slot in the sight pin body component, such as in the manner described above in relation to FIG. 21. With tube 1202 inserted as far as it can be, fiber 1204 can then be fed so that it threads through the sight pin body component, including the tube-like part, until it reaches the sight pin end, possibly turning or twisting the fiber if necessary if it resists threading, such as by catching against an edge within the sight pin body component. The optical fiber can then be cut off at an appropriate length, such as even with the end of tube 1202 or with a short exposed end of fiber 1204 extending out of tube 1202 as shown in FIG. 23. Its opposite end can be melted to provide a suitable light-emitting sight pin end.

When all the tubes have been attached and all the optical fibers threaded and melted at their sight pin ends, base part 1206 can be positioned on housing 1164 in assembly 1200, with the attached tubes containing fibers all extending upward to above base part 1206. The attached tubes containing fibers can then be drawn downward through opening 1210 in an upper, plate-like portion of base part 1206 and then laterally along an appropriate path over a lower, plate-like portion of base part 1206 on which the upper, plate-like portion is supported, such as by post-like or wall-like portions, and finally can be inserted downward through opening 1212 in the lower, plate-like portion of base part 1206 into a region within housing 1164 in which short lengths of the fibers can receive artificial illumination, such as from an attached light source (not shown) similar to a flashlight; for example, artificial illumination has been successfully provided in this manner to fiber end segments approximately one-half (0.5) of an inch in length and surrounded to the end by Tygon® polymer tubing in approximately the manner shown in end segment 1114 (FIG. 19).

After the tubes containing fibers are all in position relative to base part 1206 and housing 1164, light-transmissive cover 1220 and upper cover part 1222 can be positioned over them and fastened into position by screws 1224 and 1226, which fit into countersunk openings 1228 and 1230, respectively, in cover 1222. Covers 1220 and 1222 need not provide an air-tight light-receiving region unless designed for underwater use; for other uses, an air-tight attachment could be detrimental because air passing between the light-receiving region and the exterior can help to ventilate the light-receiving region and keep it dry. In addition to enclosing the light-receiving region, covers 1220 and 1222 protect tube 1202 and fiber 1204 inside it from external effects such as being touched or otherwise contacted by other objects, which could cause damage. Merely covering tube 1202 and fiber 1204 is not enough, however, to prevent other possible causes of damage, such as from vibration that occurs during an archer's use of a bow on which an archery sight is mounted.

FIG. 24 illustrates features of a scope assembly produced as in FIG. 23, features that can alleviate the problem of vibration-caused damage to tube 1202 and fiber 1204 inside it. The technique in FIG. 24 employs O-rings 1172 (FIG. 21), which provide positive pressure and therefore serve as damping parts between housing 1164 and base part 1206, reducing transfer of vibration from the bow through mounting components and housing 1164 to base part 1206. Because the transferred vibration is reduced, tube 1202 and fiber 1204 inside it experience less vibration and are accordingly less likely to have vibration-caused damage.

The view in FIG. 24 is a schematic cross-section that includes relevant features of an assembly produced as in FIG. 23, but omits, e.g., sight pin body components, tubes, and optical fibers. As can be seen, covers 1220 and 1222 both extend over certain parts of base part 1206, which in turn contacts the upper surfaces of O-rings 1172 on housing 1164. Screw 1224 fits through an opening in cover 1222 and into threaded opening 1240 in housing 1164. One or both of threaded opening 1240 and countersunk opening 1228 for screw 1224, however, are positioned off center relative to the opening in cover 1222 for screw 1224 in a way that, as screw 1224 is tightened, it moves cover 1222 in the direction indicated by arrow 1242, in effect pulling dovetail portion of cover 1222 against a counterpart dovetail portion of housing 1164 and, as a result, downward toward housing 1164. One or both of the threaded opening in cover 1222 and countersunk opening 1230 for screw 1226 can similarly be positioned off center relative to an opening for screw 1226 in cover 1222, so that, as screw 1226 is tightened, it also moves cover 1222 in the direction indicated by arrow 1242. As a result, the tightening of screws 1224 and 1226 is limited by positive pressure from O-rings 1172, providing the damping effect described above, reducing or preventing vibration-caused damage.

The region under cover 1220 and above base part 1206 that can receive light through cover 1220 serves as a light-receiving region in this implementation, because lateral surfaces of an optical fiber within the region can receive light through cover 1220 and through tube 1202. In accordance with constraints mentioned above, cover 1220 should be sufficiently light-transmissive that sufficient light enters the light-receiving region, and an implementation with cover 1220 made of frosted plastic or polymer material has been found to increase light-receiving efficiency over a clear cover, perhaps because the frosted polymer reflects light back into the light-receiving region better than a clear cover; also, the part of fiber 1204 extending through the light-receiving region must be sufficiently long and have sufficient lateral surface area to receive adequate light, and it has been found that a length on the order of four (4) inches can be sufficiently long even with the smaller diameter fiber described above, where the total length of fiber 1204 from the sight pin end to the opposite end within housing 1164 is on the order of seven (7) inches; also, if the optical fiber is appropriately structured, a sufficient portion of light received in the light-receiving regions propagates through the fiber and is emitted at the sight pin end so that a normal vision user can see the emitted light.

The view in FIG. 24 also shows slots 1246 and 1248, defined respectively in cover 1222 and housing 1164. A small hex wrench or other appropriate tool can be inserted through one of slots 1246 and 1248 to turn a sight pin body component's control screw 970 (FIGS. 11 and 12), changing between the body component's first and second positions as described above. For example, a hex wrench could be inserted through the appropriate slot to turn screw 970 for one sight pin counterclockwise until the respective spring 968 (FIGS. 11 and 12) pushes pivot part 960 against screw 908 (FIG. 10); then knob 924 (FIG. 10) could be turned to make the desired micro-adjustment in sight pin position; finally, the hex wrench could again be inserted through the same slot to turn screw 970 clockwise approximately one turn, so that pivot part 960 is against shaft 906 (FIG. 10) and the sight pin is held securely in place in the pin adjustment direction. If appropriate in some situations, two or more sight pins could be concurrently adjusted in the pin adjustment direction in this manner by turning both of their screws 970 clockwise before turning knob 924 to make a micro-adjustment, and so forth until they are again held securely in place.

Assembly as in FIG. 23 can also include attachment of a sight frame component, such as scope 1250, which can be implemented as described above in relation to FIGS. 1-3. Scope 1250 can be attached to housing 1164 by hex-headed screws 1252 which can be turned into respective openings in the lateral exterior surface of scope 1250, such as threaded holes 125 (FIGS. 2 and 3).

The sight frame component can also include level assembly 1254, including a small bubble-type level that indicates orientation and/or position of scope 1250 relative to second and third axes (in addition to elevation and windage, discussed below) and that a user can view when looking through scope 1250, allowing the user to make appropriate adjustments in position. The bubble-type level is an example of a "level component." Level assembly 1254 can be attached by screw 1256, extending through washer 1258, e.g., stainless steel, and then through an opening in assembly 1254, and then being turned into the appropriate one of holes 119 and 121 (FIGS. 2 and 3) in the lateral exterior surface of scope 1250; in one successful implementation, attachment of screw 1256 through hole 121 is appropriate for a right-handed user, while attachment through hole 119 is appropriate for a left-handed user, with level assembly 1254 being viewed above scope 1250 during use in each case.

Screw 1256 can be loosened to make third axis adjustments. With the bow on which the archery sight is supported canted 45 degrees downward and with screw 1256 loose, level assembly 1254 can be manually positioned so that a bubble within assembly 1254 is centered. Then screw 1256 can again be tightened to hold assembly 1254 in position.

The sight frame component can also include decorative features such as decal 1260, such as with a trademark such as Axcel™, identifying information for scope 1250, and so forth. Also, a magnifying lens, such as a Classic Magnum Scope Lens available from Tomorrow's Resources Unlimited, Inc., Madison Heights, Va., can optionally be turned into threads 118 (FIGS. 2 and 3).

As noted above, the assembled product may also be used under low light conditions in which illumination received through cover 1220 is not sufficient to provide a visible light spot. In this situation, a small flashlight attachment (not shown) can be turned into threaded opening 1262 in cover 1222; threaded opening 1262 can, for example, be three-eighths (0.375) of an inch in diameter with a thread density of 32 per inch; alternatively, a snap-on attachment over cover 1222 might include a flashlight or other artificial light. When the flashlight attachment is turned on, it shines light on lateral sides of fibers, causing light to propagate through the fibers and to the respective sight pin ends, providing light spots that are visible under low light conditions.

The assembly operations described above in relation to FIGS. 23 and 24 are merely illustrative, and various other approaches could be taken. For example, similar operations could be performed, but with tube 1202 attached to the sight pin body component before fiber 1204 is fed into its opposite end. In any case, care must be taken so that fiber 1204 does not break, e.g., while it is fed and threaded or while tube 1202 is being inserted through openings or being drawing along its path along a wall on base part 1206.

A scope assembly produced as in FIGS. 22-24 could be mounted on a bow in many different ways. FIG. 25 illustrates features of a bow mount assembly that could be employed to mount a scope assembly on a bow. A number of the illustrated features are similar to features described in co-pending U.S. patent application Ser. No. 11/860,607 (the "Bowsight Support Application"), entitled "Supporting Bowsights" and incorporated herein by reference in its entirety. Some of the illustrated features are alternatives to features described in the Bowsight Support Application and could instead be implemented as described therein. As in the Bowsight Support Application, the bow mount assembly allows for adjustments of elevation and windage, adjustments which an archer is likely to make at least daily; the scope assembly as described above also allows for individual adjustment of sight pin position, such as for a specific arrow, and an archer is likely to make such adjustments less frequently, perhaps once for a session of several days or when changing between types of arrows.

Mounting bar 1300 is an elongated part that can be attached to an archer's bow using screw or similar fasteners that extend through openings defined in bar 1300. Alternatively, a bar could be used that is attached to a bow using a bracket, as described in relation to FIG. 1 of the Bowsight Support Application.

An archery sight system mounted on a bar such as mounting bar 1300 provides a framework of orientation that can be described as follows: The center of the framework of orientation can be the area in which mounting bar 1300 or another bar or other part of the system is attached to the bow; directions set forth below are referred to in the same way, however, when the bow is in other positions than that used in shooting arrows or even when the archery sight system is detached from the bow. A direction from this center of orientation toward the archer is referred to as "backward", "rearward", "behind", and so forth, while directions from the center of orientation toward a target are referred to as "forward", "in front", or the like. When the archer is holding the bow upright, a direction toward the ground is referred to as "down", "downward" or the like, while the opposite direction is referred to as "up", "upward" or the like. Also, directions perpendicular both to the forward-backward direction and to the upward-downward direction, i.e., "lateral directions", can be referred to as "leftward" and "rightward" according to the archer's position, and a lateral direction away from a central plane of the bow leftward or rightward can be referred to as "outward", while a lateral direction toward a central plane of the bow can be referred to as "inward".

When mounted on a bow for use, mounting bar 1300 extends forward, away from the archer, such as toward a target, and holds other components of a system that assists the archer in reliably aiming at targets by using a bowsight or archery sight; for example, the system can include several components, each of which allows adjustment of the bowsight's position or orientation. Between bar 1300 and other such components is illustratively a vibration absorbing component, an optional component that can be implemented with a commercially available part such as a Mathews Harmonic Damper from Mathews Inc., including rubber housing 1302 and weight 1304 mounted in rubber housing 1302. In the illustrated implementation, mounting bar 1300 has a fixed length, but bars of several convenient lengths could be available for each archer to choose, and each size could be available with or without a vibration absorbing component.

In the exemplary implementation illustrated in FIG. 25, a first set of parts, relating to windage adjustment, are attached to and supported on mounting bar 1300, including windage bar 1306, which can be moved in a windage direction relative to mounting bar 1300. The term "windage direction" is used herein to refer to a lateral, leftward-rightward direction relative to a bow on which mounting bar 1300 is supported. Adjustment in the windage direction is typically made to account for wind conditions.

A second set of parts, relating to elevation adjustment, are attached to and supported by windage bar 1306, including elevation clamp 1308. A scope assembly as described above in relation to FIGS. 22-24 is attached to and supported by elevation clamp 1308, and can be moved in an elevation direction relative to elevation clamp 1308 and windage bar 1306. The term "elevation direction" is used herein to refer to a direction upward and downward relative to a bow on which mounting bar 1300 is supported. In general, movement in the elevation direction determines the upward and downward position of a bowsight.

Both types of adjustments, windage and elevation, are illustratively made by moving two parts with interfitting dovetail track portions relative to each other using a screw that extends through a threaded opening in a special type of nut, referred to herein as a "dovetail dowel nut", which could be made, for example, of bronze: Dovetail dowel nut 1310 is used in windage adjustment, and dovetail dowel nut 1312 is used in elevation adjustment. Windage and elevation adjustments are sometimes referred to herein as "gang adjustments" because they affect all the sight pins, in contrast to adjustments in the pin adjustment direction, which are typically made by moving one individual sight pin at a time as described above. As noted above, gang adjustments are likely to be made at least daily, while individual sight pin adjustments are likely to be made less often, e.g., once for a session of several days.

Mounting bar 1300 illustratively has a female dovetail track portion defined in its rightward end in FIG. 25. Windage bar 1306 has a mating male dovetail track portion defined in its leftward side in FIG. 25, within which is defined track opening 1320. With nut 1310 extending into track opening 1320, windage screw 1322 can be inserted through bushing 1324 and then turned through a threaded opening in nut 1310 until it extends out the end of windage bar 1306, so that bushing 1326 can be put onto it and then windage knob 1328 can be attached, held in place, e.g., by set screw 1330 and ball 1332, such as a ball made of Delrin® brand Acetal from DuPont Corporation and having a diameter of one-eighth (0.125) of an inch. To provide feedback as knob 1328 is turned, ball bearing 1334, e.g., a chrome plated steel ball having a diameter of one-eighth (0.125) of an inch, biased by spring 1336, can be in a hole in windage bar 1306 and can engage grooves on knob 1328 to provide clicks as knob 1328 turns, similarly to techniques described in the Bowsight Support Application; each click can, for example, be one-twentieth of a revolution, causing movement of 0.00156 of an inch in the windage direction. Screw 1322 could be implemented, for example, with a #6 size and 32 pitch (32 threads per inch) pan-headed Phillips screw having a diameter of 0.138 inch and of an appropriate length.

Thumb knob component 1314 extends through openings transverse to the female dovetail track on each side of gap 1315; the opening on the near side of gap 1315 in FIG. 25 is threaded, as is the lateral surface of thumb knob component 1314, so that component 1314 can be tightened to secure the male dovetail track on windage bar 1306 in position along the length of the female dovetail track. To make a windage adjustment, component 1314 can be loosened, knob 1328 can be turned an appropriate number of clicks, and component 1314 can be again tightened to hold windage bar 1306 in the resulting position. Windage bar 1306 can have markings similar to those shown in FIG. 1 of the Bowsight Support Application, but for use in making windage adjustments rather than elevation adjustments, and knob 1328 can similarly have markings as shown in the Bowsight Support Application.

Elevation clamp 1308 similarly has a female dovetail track portion defined in its rightward side in FIG. 25. Thumb knob component 1316 similarly extends through openings transverse to the female dovetail track on each side of gap 1318; the opening on the lower side of gap 1318 in FIG. 25 is threaded, as is the lateral surface of thumb knob component 1316, so that component 1316 can similarly be tightened to secure the male dovetail track on housing 1164 (FIG. 24) in position along the length of the female dovetail track.

Elevation clamp 1308 can be attached to windage bar 1306 by extending screws 1340 through washers 1342 and then through respective holes 1346 in windage bar 1306 to threaded holes in elevation clamp 1308. Clamp 1308 illustratively has alignment knob 1344 on its surface facing bar 1306, allowing precise positioning before screws 1340 are inserted and turned into the threaded holes. Openings 1346 and counterpart openings (not shown) on the other side of windage bar 1306 are oblong and unthreaded, so that screws 1340 can be loosened to allow second axis adjustment: With the bow positioned so that the bowstring is vertical, elevation clamp 1308 can be turned within the range allowed by openings 1346 until an appropriate second axis position is reached; screws 1340 can then be tightened to hold the resulting second axis position. Also, alternative openings in windage bar 1306 and elevation clamp 1308 allow a user to choose a different range for windage and/or elevation adjustment.

Mounting bar 1300 illustratively has a number of holes defined therein, and could have a different number of holes or differently positioned holes as appropriate. In the illustrated example, holes 1350 serve as three-position bow mounting holes, while holes 1352 serve as quiver mounting holes.

Parts and components shown in FIG. 25 could be implemented in various ways in addition to the specific examples mentioned above. For example, mounting bar 1300, windage bar 1306, and elevation clamp 1308 can all be machined or cast in aluminum or another suitable metal or metal alloy or another appropriate material, and each could have any other appropriate shape, size, or other features other than those illustrated.

Finally, as shown in FIG. 26, scope assembly 1360 produced as described in relation to FIGS. 22-24 can be attached to the bow mount assembly 1362 in a similar way to the attachment of windage bar 1306 to mounting bar 1300. Housing 1164 in assembly 1360 has a male dovetail track portion defined in its lower side as shown in FIG. 24, within which is defined a track opening similar to track opening 1320 (FIG. 25); the male dovetail track portion fits into the female dovetail track portion in elevation clamp 1308 in assembly 1362.

With nut 1312 extending from elevation clamp 1308 into the track opening in housing 1164, elevation screw 1364, similar to screw 1322 (FIG. 25), can be inserted through bushing 1366 and then turned through a threaded opening in nut 1312 until it extends out the end of housing 1164, so that bushing 1368 can be put onto it and then elevation knob 1370 can be attached, held in place, e.g., by set screw 1372 and ball 1374, similar to ball 1332 (FIG. 25). To provide feedback as knob 1370 is turned, ball bearing 1376, similar to ball bearing 1334, biased by spring 1378, can be in a hole in housing 1164 and can engage grooves on knob 1370 to provide clicks as described above for knob 1328; each click can, for example, be one-twentieth of a revolution, causing movement of 0.00156 of an inch in the elevation direction.

To make an elevation adjustment, component 1316 can be loosened, knob 1370 can be turned an appropriate number of clicks, and component 1316 can be again tightened to hold scope assembly 1360 in the resulting position. Housing 1164 can have markings similar to those shown in FIG. 1 of the Bowsight Support Application for use in making elevation adjustments, and knob 1370 can similarly have markings as shown in the Bowsight Support Application.

Archery sight 100 as in FIG. 1 can be incorporated into an article of manufacture that includes packaging materials as well as additional tools and parts. For example, the article of manufacture could include screws for attaching mounting bar 1300 to a bow, as well as one or more hex wrenches that a user is likely to need often, such as for adjusting pin position, for loosening and tightening screws 1340 or screw 1256 during adjustment, and so forth. Archery sight 100, the other parts, and printed materials can all be packaged together in a clear plastic container shaped to fit around sight 100, providing an attractive, hangable product that also allows a user to see and understand features of sight 100 without opening the package.

The techniques described above in relation to FIGS. 1-26 make it possible to produce and use a pin-based archery sight with several beneficial features, including several mentioned above. For example, each sight pin's position can be easily adjusted individually, gang adjustments of elevation and windage are easy to make, and second and third axis adjustments are also available. Also, optical fibers that emit light at sight pin ends, as described above, are protected against damage from contact, touching, and vibration, and can be illuminated from outside light and/or from an attached flashlight. Tube-like parts that hold and protect the fibers can be held in position relative to a sight pin body component by bends or kinks, possibly without any other form of attachment, yet the bends or kinks do not interfere with threading of fibers through the tube-like parts during production. When viewed by an archer through a scope as described above, the sight pins can be seen within a substantially circular field across a range of angles around a central viewing axis. Furthermore, although described in relation to sight pins with light-emitting optical fibers, some of the techniques might be applied to sight pins that are not illuminated and possibly even to archery sights that do not include sight pins or to sights used in applications other than archery.

The exemplary implementations described above are illustrated and some have been successfully prototyped, tested, and produced with specific shapes, dimensions, materials and other characteristics, but the scope of the invention includes various other shapes, dimensions, materials and characteristics. For example, the particular shape of each of the parts could be different, and could be of appropriate sizes for any particular archer's preference. Furthermore, rather than being fabricated from separate parts or layers, including conventional machining techniques for smooth edges and so forth, the parts and structures as described above could be manufactured in various other ways and could include various other materials. For example, body parts and other parts, components, or structures could be integrally formed, such as by casting or molding metal or plastic material.

Similarly, the exemplary implementations described above include specific examples of sight frame components, sight pins, sight pin body components, support components and structures, body parts, tube-like parts, tubing parts, adjustment parts, and so forth, but any appropriate implementations of those components, structures, and parts could be employed. For example, scopes and other sight frame components as described herein could be used with or without sight pins as described herein, and vice versa. Also, in implementations with sight pins, features could be provided that allow replacement of sight pins, so that sight pins could be marketed as separate products. Further, the above exemplary implementations employ specific ways of producing and/or using various archery sights or parts or components, but a wide variety of other ways could be used within the scope of invention. Operations could be performed in different order, some operations might be omitted, and additional operations could be added While the invention has been described in conjunction with specific exemplary implementations, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. An archery sight comprising:

a support component that includes a light receiving region;

a sight frame component supported by the support component, the sight frame component comprising:

a scope having an inner surface shaped to produce a Venturi-like effect when viewed at angles slightly greater than zero degrees up to about five degrees from a central axis of the scope;

at least one sight pin within the sight frame component, the sight pin including:

a sight pin body component that includes a surface having a slot; and a tube-like part; and at least one optical fiber extending within the light receiving region and from the light receiving region through the slot in the sight pin body component and into the tube-like part; a length of the at least one optical fiber being within the light receiving region and between the light receiving region and the tube-like part.

2. An archery sight as defined in claim 1, and further comprising flexible tubing that surrounds the at least one optical fiber along at least a majority of the length.

3. The archery sight of claim 2, wherein the flexible tubing surrounds the at least one optical fiber along substantially all of the length.

4. An archery sight comprising:

a scope having a sight opening extending through it between two ends, the scope having an inner surface having a variable inner diameter;

the inner diameter being a minimum diameter at a waist point intermediate said scope ends; and at least one sight pin within the scope, each sight pin having an open end, the open end being oriented to be at approximately the same position as the waist point within said sight opening.

5. An archery sight as defined in claim 4, wherein said scope has at least one inner surface region defining a boundary segment of the sight opening, said inner region being shaped so that its boundary segment appears to the user to be substantially along a circle when the sight opening is viewed along a central axis and at any angle from the central axis up to a maximum circular viewing angle greater than zero degrees and less than or equal to seven degrees relative to the central axis.

6. An archery sight as defined in claim 4, wherein said scope has an inner surface shaped to produce a Venturi-like effect when viewed at angles other than along a central axis of the scope.

7. An archery sight as defined in claim 6, wherein said scope includes a shoulder, the shoulder and the waist point being at approximately the same position along the central axis of the scope.

8. An archery sight as defined in claim 6, wherein said Venturi-like effect is produced when said scope is viewed at angles slightly greater than zero degrees up to about five degrees relative to the central axis of the scope.

9. An archery sight as defined in claim 4, wherein said sight pin comprises a sight pin body containing an opening, a tube-like part connected within said sight pin body opening and defining said open end, and at least one optical fiber extending within said sight pin body and through said tube-like part to deliver ambient light to said open end.

10. An archery sight as defined in claim 9, wherein said optical fiber extends from the sight pin end through said tube-like part and said body and exiting an exit opening in said body part to the exterior of said sight, said optical fiber including light-receptive lateral sides and extending a length from the exit opening for capturing ambient light.

11. An archery sight as defined in claim 10, and further comprising a flexible, light-transmissive tubing part that surrounds said optical fiber along at least a majority of its exterior length.

12. An archery sight as defined in claim 4, and further comprising an adjustable sight pin support assembly for adjusting the position of said sight pin within said scope.

13. An archery sight as defined in claim 12, wherein said sight pin support assembly comprises a turnable part that extends in a pin adjustment direction and has a threaded lateral surface.

14. An archery sight as defined in claim 4, and further comprising a support component that includes a light receiving region, said support component connecting said scope with a bow.

15. An archery sight as defined in claim 14, and further comprising a level component mounted on said scope, said level component indicating whether said scope has a level position with respect to a level axis, said level component being adjustable to change the position of the level axis relative to said scope.

16. An archery sight as defined in claim 14, wherein said support component comprises a housing that extends around an opening;

a screw that extends across the opening and into a portion of said housing at each of its ends; and a stabilizing shaft that extends across the opening and into the housing portions at each of its ends, said stabilizing shaft having a stabilizing surface.

17. An archery sight as defined in claim 14, wherein said support component comprises a mount assembly including a windage adjustment device operable by the user to adjust the position of said sight in a windage direction and an elevation adjustment device operable by the user to adjust the position of said sight in an elevation direction generally perpendicular to said windage direction.

18. An archery sight comprising:

a scope having a sight opening extending through it between two ends, the scope having an inner surface having a variable inner diameter;

the inner diameter being a minimum diameter at a waist point intermediate said scope ends; and at least one sight pin within the scope, each sight pin having an open end, the open end being oriented to be within said sight opening.

* * * * *